US007352334B2

(12) United States Patent
Kuroda et al.

(10) Patent No.: US 7,352,334 B2
(45) Date of Patent: Apr. 1, 2008

(54) WIDEBAND ANTENNA

(75) Inventors: Shinichi Kuroda, Tokyo (JP); Hisato Asai, Tokyo (JP); Tomoya Yamaura, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/488,678

(22) Filed: Jul. 19, 2006

(65) Prior Publication Data

US 2006/0262019 A1 Nov. 23, 2006

Related U.S. Application Data

(62) Division of application No. 10/498,813, filed as application No. PCT/JP03/13487 on Oct. 22, 2003, now Pat. No. 7,132,993.

(30) Foreign Application Priority Data

| | | |
|---|---|---|
| Oct. 23, 2002 | (JP) | 2002-307908 |
| Oct. 23, 2002 | (JP) | 2002-307909 |
| Oct. 30, 2002 | (JP) | 2002-315381 |
| Feb. 26, 2003 | (JP) | 2003-49895 |
| Feb. 26, 2003 | (JP) | 2003-49896 |
| Mar. 31, 2003 | (JP) | 2003-96903 |

(51) Int. Cl.
*H01Q 13/10* (2006.01)

(52) U.S. Cl. ..... 343/772; 343/786

(58) Field of Classification Search ..... 343/772, 343/773, 786

See application file for complete search history.

(56) References Cited

U.S. PATENT DOCUMENTS

| | | | | |
|---|---|---|---|---|
| 3,401,387 A | | 9/1968 | Milligan et al. | |
| 4,143,377 A | | 3/1979 | Salvat et al. | |
| 4,851,859 A | * | 7/1989 | Rappaport | 343/790 |
| 4,907,010 A | | 3/1990 | Wright | |

(Continued)

FOREIGN PATENT DOCUMENTS

| | | |
|---|---|---|
| JP | 64-5203 | 1/1989 |
| JP | 1-32681 | 7/1989 |
| JP | 02246502 | 10/1990 |
| JP | 2-270405 | 11/1990 |
| JP | 8-138515 | 5/1996 |
| JP | 8-139515 | 5/1996 |
| JP | 2002-298105 | 10/2002 |

OTHER PUBLICATIONS

U.S. Appl. No. 11/488,753, filed Jul. 19, 2006, Kuroda, et al.

(Continued)

*Primary Examiner*—Trinh Vo Dinh
(74) *Attorney, Agent, or Firm*—Oblon, Spivak, McClelland, Maier & Neustadt, P.C.

(57) ABSTRACT

A monoconical antenna comprises: a substantially conical concavity formed in one end face of a dielectric; a radiation electrode provided on the surface of the concavity; and a ground conductor provided in proximity to and substantially in parallel with the other end face opposite the one end face of the dielectric. The monoconical antenna is so constituted that electrical signals are fed to between the near vertex region of the radiation electrode and the region of the ground conductor. The half-cone angle $\alpha$ of the substantially conical concavity formed in the one end face of the dielectric is determined by a predetermined rule corresponding to relative dielectric constant $\in_r$. Thus, the quality of wideband characteristics inherent in the monoconical antenna can be sufficiently maintained, and further size reduction can be accomplished by dielectric loading.

10 Claims, 26 Drawing Sheets

U.S. PATENT DOCUMENTS

| | | | | |
|---|---|---|---|---|
| 5,038,152 | A | 8/1991 | Wong et al. | |
| 5,506,592 | A | 4/1996 | MacDonald et al. | |
| 6,661,389 | B2 | 12/2003 | Griessbaum et al. | |
| 6,956,534 | B2 * | 10/2005 | Hagiwara | 343/773 |
| 2003/0025642 | A1 | 2/2003 | Jocher | |

OTHER PUBLICATIONS

U.S. Appl. No. 11/488,678, filed Jul. 19, 2006, Kuroda, et al.

F. Nusseibeh, et al., "Transient response of a wide-angle cone with dielectric loading", Radio Science, vol. 31, No. 5, XP-008052172, Sep.-Oct. 1996, pp. 1047-1052.

Shinichi Kuroda, et al., "A study of dielectric covered mon-conical antenna for broadband and small-sized appliction", Ubiquitous Technology Laboratories, Sony Corporation, Tokyo, Japan.

Jeong Hwan Kim, et al., "TEM Horn Antenna for the Time Domain Shielding Effectiveness Measurement", Electromagnetic Compatibility Proceedings, 1997. 1997 International Symposium on Beijing, China May 21-23, 1997, New York, NY USA, IEEE, US, May 21, 1997, pp. 265-269.

Dr. Eric Clouston, "The Butterfly: A Broadband, Aerodynamic Antenna for Airborne Missile Scoring Using Impulse Radar", Proceedings of the Antennas and Propagation Society Annual Meeting. 1991. Venue and Exact Data Not Shown, New York, IEEE, US vol. 2, Jun. 24, 1991, pp. 715-718.

James G. Maloney, "Optimization of a Conical Antenna for Pulse Radiation: An Efficient Design Using Resistive Loading", IEEE Transactions on Antenna and Propagation, IEEE Service Center, Piscataway, NJ, US, vol. 41, No. 7, Jul. 1, 1993, pp. 940-947.

Caldecott, R., et al., "An Underground Mapping System Using Impulsle Radar, 7th" IEEE/PES Transmission and Distribution Conference and Exposition, Apr. 1-6, 1979, pp. 99-107.

Shinichi Kuroda, et al., "A study of dielectric covered mon-conical antenna for broadband and small-sized appliction", Ubiquitous Technology Laboratories, Sony Corporation, Tokyo, Japan, no date.

* cited by examiner

CROSS-SECTIONAL VIEW

CROSS-SECTIONAL VIEW

CROSS-SECTIONAL VIEW

CROSS-SECTIONAL VIEW

WIDEBAND ANTENNA

CROSS REFERENCE TO RELATED APPLICATIONS

This application is a Divisional of application Ser. No. 10/498,813 filed Feb. 1, 2005 now U.S. Pat. No. 7,132,993, and claims priority under 35 U.S.C. 120, which is the National Stage of PCT/JP03/13487 filed Oct. 22, 2003. This application also claims benefit under 35 USC 119 based on Japanese Patent Application No. 2002-307908 filed Oct. 23, 2002, Japanese Patent Application No. 2002-307909 filed Oct. 23, 2002, Japanese Patent Application No. 2002-315381 filed Oct. 30, 2002, Japanese Patent Application No. 2003-49895 filed Feb. 26, 2003, Japanese Patent Application No. 2003-49896 filed Feb. 26, 2003, and Japanese Patent Application No. 2003-96903 filed Mar. 31, 2003. The entire contents of all are incorporated by reference herein.

TECHNICAL FIELD

The present invention relates to an antenna used in radio communication including wireless LAN. More particularly, it relates to a wideband antenna comprising a radiation electrode provided in a substantially conical concavity formed in one end face of a dielectric; and a ground conductor provided on the other end face of the dielectric.

Further particularly, the present invention relates to a wideband antenna wherein its inherent quality of wideband characteristics is sufficiently maintained and further size reduction is accomplished by dielectric loading. Especially, it relates to a wideband antenna wherein reduction in profile and width is accomplished regardless of the selection of dielectric.

Further, the present invention relates to a wideband antenna whose band is widened using resistive loading on a radiation conductor, and to a wideband antenna comprising a radiation conductor which can be mass-produced with ease and is constituted by resistive loading.

BACKGROUND ART

With the enhancement of speed of and the reduction in the price of wireless LAN systems, recently, the demand for them has significantly grown. Especially these days, the introduction of personal area network (PAN) has been widely considered to build a small-scale wireless network among a plurality of pieces of electronic equipment common around the house for information communication. For example, different radio communication systems have been defined using frequency bands, such as 2.4-GHz band and 5-GHz band, for which licenses from competent authorities are unnecessary.

In radio communication including wireless LAN, information is transmitted through antennas. For example, a monoconical antenna comprises a radiation electrode formed in a substantially conical concavity in a dielectric, and a ground electrode formed on the bottom face of the dielectric. Thus, a small antenna having relatively wideband characteristics can be constituted by the wavelength shortening effect from the dielectric positioned between the radiation electrode and the ground electrode.

An antenna having wideband characteristics can be used in UWB (Ultra-Wide Band) communication wherein, for example, data is spread in as ultra-wide a frequency band as 3 GHz to 10 GHz for transmission and reception. A small antenna contributes to reduction in the size and weight of radio equipment.

For example, Japanese Unexamined Patent Publication No. Hei 8(1996)-139515 discloses a small dielectric vertical polarization antenna for wireless LAN. This dielectric vertical polarization antenna is constituted as follows: one base of a cylindrical dielectric is conically hollowed out, and a radiation electrode is formed there, and an earth electrode is formed on the base on the opposite side. The radiation electrode is drawn out to the earth electrode side through a conductor in a through hole. (Refer to FIG. 1 in the Unexamined Patent Publication.)

FIG. 5 in the Unexamined Patent Publication illustrates the antenna characteristics of this dielectric vertical polarization antenna. According to the figure, its operating band is approximately 100 MHz. (The center frequency is approximately 2.5 GHz; therefore, the relative bandwidth is approximately 4%.) The monoconical antenna has inherently an operating band not less than one octave; therefore, it cannot be said that the above antenna sufficiently delivers expected wideband characteristics.

The miniaturization of an antenna means reduction in, for example, its profile or width. For example, Japanese Unexamined Patent Publication No. Hei 9(1997)-153727 presents a proposal with respect to reduction in the width of monoconical antenna. However, the proposal is such that a radiation conductor should be simply formed in the shape of semi-elliptic solid of revolution, and whether it is applicable to the structure of an antenna whose side face is covered with dielectric without any modification is unknown.

FIG. 31 schematically illustrates the constitution of a monoconical antenna having a single conical radiation electrode. The monoconical antenna illustrated in the figure comprises a radiation conductor formed in substantially conical shape, and a ground conductor formed with a gap provided between it and the radiation conductor. Electrical signals are fed to the gap.

FIG. 32 illustrates an example of the VSWR (Voltage Standing Wave Ratio) characteristics of a monoconical antenna. A VSWR not more than 2 is attained over a wide range from 4 GHz to 9 GHz, and this indicates that the antenna has a wide relative bandwidth.

One of known methods for further widening the band of this monoconical antenna is loading resistance on the radiation conductor. FIG. 33 and FIG. 34 illustrate examples of the constitutions of monoconical antennas whose radiation conductor is formed of a low-conductivity member containing a resistance component, instead of high-conductivity metal. With this constitution, reflective power to a feeding portion is diminished, and this results in expanded matching band. Especially, since the lower limit frequency of the matching band is expanded (downward), the above constitutions are also utilized as means for the reduction of antenna size. As illustrated in FIG. 33, the radiation electrode may be formed of a material having a constant low conductivity. However, if the conductivity is distributed as illustrated in FIG. 34 (lower conductivity on the upper base side), the effect is produced better.

Various methods are known for loading resistance on the radiation conductor of a monoconical antenna. Concrete examples include a method of sticking a low-conductivity member formed in sheet shape to a conical insulator, and a method of applying a low-conductivity member prepared as coating material. (Refer to "Optimization of a Conical Antenna for Pulse Radiation: An Efficient Design Using Resistive Loading," written by James G. Maloney, et al. (IEEE Transactions on Antennas and Propagation, Vol. 41, No. 7, July, 1993, pp. 940-947), for example.)

However, if mass production is considered, the method of sticking a sheet is indeed inferior in productivity, and is not realistic. With the method of applying coating, it is difficult to make the thickness of coating uniform to control conductivity, and this method is also unrealistic.

DISCLOSURE OF THE INVENTION

An object of the present invention is to provide an excellent monoconical antenna comprising a radiation electrode provided in a substantially conical concavity formed in one end face of a dielectric, and a ground conductor provided on the other end face of the dielectric.

Another object of the present invention to provide an excellent monoconical antenna wherein its inherent quality of wideband characteristics is sufficiently maintained and further size reduction is accomplished by dielectric loading.

A further object of the present invention is to provide an excellent monoconical antenna wherein reduction in profile and width is accomplished regardless of the selection of dielectric.

A further object of the present invention is to provide an excellent monoconical antenna having a feeding portion structure suitable for mass production.

A further object of the present invention is to provide an excellent conical antenna wherein resistance is loaded on its radiation conductor for band widening.

A further object of the present invention is to provide an excellent antenna comprising a radiation conductor which can be mass-produced with ease and is constituted by resistive loading.

The present invention has been made with the above problems taken into account. A first aspect of the present invention is a monoconical antenna comprising: a substantially conical concavity formed in one end face of a dielectric; a radiation electrode provided on the surface of the concavity; and a ground conductor provided in proximity to and substantially in parallel with the other end face of the dielectric opposite the one end face. The monoconical antenna is so constituted that electrical signals are fed to the part between the near vertex region of the radiation electrode and the region of the ground conductor.

The monoconical antenna is characterized in that:

the half-cone angle $\alpha$ of the substantially conical concavity formed in the one end face of the dielectric is determined by a predetermined rule according to relative dielectric constant $\epsilon_r$.

However, "half-cone angle of concavity" herein referred to is defined as the angle formed between the central axis of a cone and its side face.

According to the present invention, the quality of wideband characteristics a monoconical antenna inherently has is sufficiently maintained and further size reduction is accomplished by dielectric loading.

The half-cone angle $\alpha$ of the substantially conical concavity formed in the one end face of the dielectric can be determined by the following expression that describes its relation with relative dielectric constant $\epsilon_r$:

$$\alpha=0.8\cdot\tan^{-1}(1.7/\epsilon_r)+13 \text{ (Unit of angle: degree)}$$

From the result of several simulations, the present inventors found that: the half-cone angle value which optimizes the matching of a circular cone formed in one end face of a dielectric depends on the relative dielectric constant $\epsilon_r$ of the dielectric covered. The above approximate expression is obtained by appropriately formulating an approximate expression and adjusting its coefficients.

The half-cone angle $\alpha$ of the substantially conical concavity is defined case by case as follows: in case of a circular cone, the angle is that formed between the central axis of the circular cone and its side face. In case of an elliptic cone or a pyramid, the angle is the average of the minimum angle and the maximum angle formed between the central axis and the side face.

The radiation electrode may be formed so that the substantially conical concavity is filled with it.

A second aspect of the present invention is a monoconical antenna comprising: a substantially conical concavity formed in one end face of a dielectric; a radiation electrode provided on the surface of the concavity or a radiation electrode provided so that the concavity is filled with it; and a ground conductor provided in proximity to and substantially in parallel with the other end face of the dielectric opposite the one end face. The monoconical antenna is so constituted that electrical signals are fed to the part between the near vertex region of the radiation electrode and the region of the ground conductor.

The monoconical antenna is characterized in that:

the ratio of the height h of the concavity to the effective radius r of the base of the concavity is determined by a predetermined rule according to the relative dielectric constant $\in_r$ of the dielectric.

However, "height of concavity" herein referred to is defined as the length of the segment of a perpendicular drawn from the vertex of the concavity to the base of the concavity. "effective radius of base of concavity" is defined as the average distance between the center point, for which the point of intersection of the base of the concavity and the perpendicular is taken, and the outer envelope of the base. "Half-cone angle of concavity" is defined as the angle formed between a tangent of the side face of the concavity and the perpendicular.

The present inventors found that a setting of the half-cone angle of a monoconical antenna has great influence on impedance matching band. Then, the present inventors derived the following: the impedance matching band can be maximized by determining the half-cone angle $\alpha$ (angle formed between the central axis and the side face of a cone) of a conical concavity formed in one end face of a dielectric by the following expression which describes its relation with relative dielectric constant $\in_r$:

$$\alpha=0.8\cdot\tan^{-1}(1.7/\in_r)+13 \text{ (Unit of angle: degree)}$$

That is, the optimum half-cone angle of a circular cone depends on the relative dielectric constant of the dielectric. In a monoconical antenna constituted based on the above expression, its side face is covered with a dielectric; therefore, the effect of miniaturization is inevitably produced. (This is caused by that the wavelength of the electromagnetic field produced between the radiation electrode and the ground conductor is shortened.) In packaging, therefore, a relative dielectric constant, that is, a dielectric is appropriately selected to meet requests for miniaturization, and then a half-cone angle of the circular cone is determined.

If a monoconical antenna is formed based only on such a constituting method, reduction in the size of the antenna can be accomplished by enhancing the relative dielectric constant $\in_r$ of the dielectric. However, in conjunction with this, the half-cone angle $\alpha$ is also reduced (that is, the antenna becomes longer than is wide). Therefore, the height of the antenna is not extremely reduced. If it is desired that an antenna is extremely slenderly formed, the relative dielectric constant $\in_r$ can be enhanced according to the above expression. As a matter of fact, however, dielectrics of various relative dielectric constants do not infinitely exist.

In short, the half-cone angle of a circular cone whose profile or width is reduced deviates from an optimum value which brings favorable impedance matching. To cope with this, the present invention is so constituted that it is compensated by stepping the half-cone angle.

A case where low-profile constitution is adopted will be taken as an example. In this case, the half-cone angle of the concavity is varied stepwise so that it is reduced as it goes from the base portion to the vertex portion in accordance with the following expression. This expression describes the relation between the ratio of the height h of the concavity to the effective radius r of the base of the concavity and relative dielectric constant $\epsilon_r$.

$$\tan^{-1}(r/h)>0.8\cdot\tan^{-1}(1.7/\in_r)+13 \text{ (Unit of angle: degree)}$$

A case where slender constitution is adopted will also be taken as another example. In this case, the half-cone angle of the concavity is varied stepwise so that it is increased as it goes from the base portion to the vertex portion in accordance with the following expression. This expression describes the relation between the ratio of the height h of the concavity to the effective radius r of the base of the concavity and relative dielectric constant $\in_r$.

$$\tan^{-1}(r/h)<0.8\cdot\tan^{-}(1.7/\in_r)+13 \text{ (Unit of angle: degree)}$$

In either case of low-profile constitution and slender constitution, two steps of half-cone angle are basically sufficient. Needles to add, the number of steps may be increased to three or more, or a portion where the half-cone angle is continuously varied may be present.

However, the half-cone angle at the vertex portion of a radiation electrode must be less than 90 degrees. Further, it is preferable that variation in half-cone angle should be gentle in proximity to the vertex portion of a radiation electrode. It follows that an effort should be made to maintain an equiangular circular cone in proximity to the vertex portion, that is, the feeding portion in accordance with Rumsey's Equiangular Theory. (For Rumsey's Equiangular Theory, refer to "Frequency Independent Antenna," written by V. Rumsey (Academic Press, 1966)). Care must be taken not to depart from the above principle. Otherwise, the ultra-wideband characteristics inherent in the monoconical antenna can be lost.

Here, the following constitution may be adopted: an electrode for feeding is formed over the above other end face, and the dielectric is penetrated. Thus, the radiation electrode and one end of the feeding electrode are electrically connected together in the near vertex region. Further, the other end of the feeding electrode may be formed so that it reaches the side face of the dielectric. In this case, electrical signals are fed to between the other end of the feeding electrode and the ground conductor. Therefore, a feeding portion structure suitable for mass production is obtained.

A third aspect of the present invention is a monoconical antenna comprising: a substantially conical radiation electrode; and a ground conductor provided in proximity to the radiation electrode. The monoconical antenna is so constituted that electrical signals are fed to between the near vertex region of the radiation electrode and the region of the ground conductor.

The monoconical antenna is characterized in that:

the straight line connecting the vertex of the substantially conical radiation electrode and the center of the base of the cone is not perpendicular to the base of the cone. However, "base of cone" herein referred to includes cases where the base of a cone faces upward.

The monoconical antenna according to the second aspect of the present invention is so constituted that: when the antenna is reduced in profile or width based on the optimum value of half-cone angle, deviation of the half-cone angle from the optimum value is compensated by stepping the half-cone angle. In this case, a problem arises. The half-cone angle obtained when the profile is reduced deviates from the optimum value which brings favorable impedance matching.

To cope with this, the monoconical antenna according to the third aspect of the present invention is so constituted that impedance matching is compensated by setting the vertex of the circular cone off the center.

A fourth aspect of the present invention is a conical antenna comprising:

an insulator;

a substantially conical concavity formed in one end face of the insulator;

a radiation electrode formed on the internal surface of the concavity;

a stripped portion obtained by circumferentially stripping part of the radiation electrode;

a low-conductivity member filled in the concavity to the level at which at least the stripped portion is buried; and a ground conductor provided in proximity to and substantially in parallel with the other end face of the insulator or formed directly on the other end face of the insulator.

The conical antenna according to the fourth aspect of the present invention basically functions as a monoconical antenna. By the way, no conductor is present on the upper base; however, this does not become a cause of preventing the proper operation of the monoconical antenna. In addition, since the low-conductivity member exists between the two divided radiation electrodes, the electrical effect equivalent to resistive loading is produced.

The radiation electrode may be formed on the internal surface of the concavity by plating or the like.

The low-conductivity member may be constituted using rubber or elastomer containing conductor.

Electrical signals are fed to the gap between the radiation electrode and the ground conductor. Alternatively, electrical signals may be fed by making a hole in the ground conductor and drawing the vertex region of the radiation electrode to the back face.

As mentioned above, the presence of the low-conductivity member between the radiation electrodes divided by the stripped portion produces the electrical effect equivalent to resistive loading. For this purpose, two or more circumferential stripped portions may be provided as required.

If two or more stripped portions for circumferentially stripping part of the radiation electrode are provided, the low-conductivity member filled in the concavity may be provided with multilayer structure. The multilayer structure is such that members different in conductivity are filled in the concavity level by level at which each stripped portion is buried. At this time, the low-conductivity members are so distributed that the conductivity is lower on the base side of the concavity. Thus, the effect of diminishing reflective power to the feeding portion is enhanced, and this results in expanded matching band.

A fifth aspect of the present invention is a conical antenna comprising:

an insulator;

a first substantially conical concavity provided in one end face of the insulator;

a first radiation electrode formed on the internal surface of the first concavity;

a first stripped portion obtained by circumferentially stripping part of the first radiation electrode;

a first low-conductivity member filled in the concavity to the level at which at least the first stripped portion is buried;

a second substantially conical concavity provided in the other end face of the insulator;

a second radiation electrode formed on the internal surface of the second concavity;

a second stripped portion obtained by circumferentially stripping part of the second radiation electrode; and a second low-conductivity member filled in the concavity to the level at which at least the second stripped portion is buried.

In the conical antenna according to the fifth aspect of the present invention, the formation of the ground conductor on the other end face of the insulator is omitted. The conical antenna functions as a biconical antenna wherein a radiation electrode is disposed on the internal surface of each of the substantially conical concavities symmetrically formed in both the end faces.

In the biconical antenna according to the fifth aspect of the present invention, electrical signals are fed to the gap between the first and second radiation electrodes. For this purpose, various methods can be used. For example, parallel lines can be extended from the insulator side face and connected to the vertex portions of both the radiation electrodes.

As mentioned above, the presence of the low-conductivity member between the radiation electrodes divided by the stripped portion produces the electrical effect equivalent to resistive loading. For this purpose, two or more circumferential stripped portions may be provided in the first and second radiation electrodes as required.

In this case, the first and second low-conductivity members filled in the first and second concavities may be respectively provided with multilayer structure. The multilayer structure is such that members different in conductivity are filled in the first and second concavities level by level at which each stripped portion is buried. At this time, the low-conductivity members are so distributed that the conductivity is lower on the base side of each concavity. Thus, the effect of diminishing reflective power to the feeding portion is enhanced, and this results in expanded matching band.

A sixth aspect of the present invention is a conical antenna comprising:

an insulator formed in substantially conical shape;

a radiation electrode formed on the surface of the substantially conical insulator;

a circumferential slit portion which circumferentially divides part of the radiation electrode together with the insulator thereunder;

a low-conductivity member filled in the circumferential slit portion; and a ground conductor provided in proximity to the near vertex region of the radiation electrode.

In the monoconical antenna according to the sixth aspect of the present invention, the low-conductivity member exits between the two divided radiation electrodes. Therefore, the electrical effect equivalent to resistive loading is produced.

As mentioned above, the presence of the low-conductivity member between the radiation electrodes divided by the slit portion produces the electrical effect equivalent to resistive loading. For this purpose, two or more circumferential slit portions may be provided as required.

In this case, low-conductivity members different in conductivity may be filled in the individual circumferential slit portions. At this time, the low-conductivity members are so distributed that the conductivity is lower on the base side of the insulator. Thus, the effect of diminishing reflective power to the feeding portion is enhanced, and this results in expanded matching band.

A seventh aspect of the present invention is a conical antenna comprising:

a first insulator formed in substantially conical shape;

a first radiation electrode formed on the surface of the substantially conical insulator;

a first circumferential slit portion which circumferentially divides part of the first radiation electrode together with the insulator thereunder;

a first low-conductivity member filled in the first circumferential slit portion;

a second insulator formed in substantially conical shape whose vertex is opposed to that of the first insulator and whose base is disposed symmetrically with that of the first insulator;

a second radiation electrode formed on the surface of the substantially conical insulator;

a second circumferential slit portion which circumferentially divides part of the second radiation electrode together with the insulator thereunder; and a second low-conductivity member filled in the second circumferential slit portion.

In the conical antenna according to the seventh aspect of the present invention, the formation of the ground conductor on the other end face of the insulator is omitted. The conical antenna functions as a biconical antenna wherein a radiation electrode is disposed on the surface of each of the substantially conical insulators disposed opposite to each other so that their end faces are symmetrical with each other.

As mentioned above, the presence of the low-conductivity member between the radiation electrodes divided by the circumferential slit portion produces the electrical effect equivalent to resistive loading. For this purpose, two or more circumferential slit portions may be provided as required.

In this case, low-conductivity members different in conductivity may be filled in the individual circumferential slit portions which divide the first and second radiation electrodes. At this time, the low-conductivity members are so distributed that the conductivity is lower on the base side of the insulator. Thus, the effect of diminishing reflective power to the feeding portion is enhanced, and this results in expanded matching band.

An eighth aspect of the present invention is a conical antenna comprising:

an insulator;

a substantially conical concavity provided in one end face of the insulator;

a feeding electrode formed on the surface of the near vertex region in the concavity;

a low-conductivity member filled in the concavity; and a ground conductor provided in proximity to and substantially in parallel with the other end face of the insulator or formed directly on the other end face of the insulator.

The conical antenna according to the eighth aspect of the present invention basically functions as a monoconical antenna, and the low-conductivity member acts as a radiation conductor.

The feeding electrode may be formed on the surface of the near vertex region in the concavity by plating or the like. The low-conductivity member may be constituted using rubber or elastomer containing conductor.

Electrical signals are fed to the gap between the feeding electrode and the ground conductor. For example, electrical signals are fed by making a hole in the ground conductor and extending the feeding electrode to the back face.

The low-conductivity member filled in the concavity may be provided with multilayer structure wherein members different in conductivity are respectively filled. At this time, the low-conductivity members are so distributed that the conductivity is lower on the base side of the concavity. Thus, the effect of diminishing reflective power to the feeding portion is enhanced, and this results in expanded matching band.

A ninth aspect of the present invention is a conical antenna comprising:

an insulator;

a first substantially conical concavity provided in one end face of the insulator;

a first feeding electrode formed on the surface of the near vertex region in the first concavity;

a first low-conductivity member filled in the first concavity;

a second substantially conical concavity provided in the other end face of the insulator;

a second feeding electrode formed on the surface of the near vertex region in the second concavity; and a second low-conductivity member filled in the second concavity.

In the conical antenna according to the ninth aspect of the present invention, the formation of the ground conductor on the other end face of the insulator is omitted. The conical antenna functions as a biconical antenna wherein a feeding electrode is disposed on the internal surface of each of the substantially conical concavities symmetrically formed in both the end faces.

In the conical antenna according to the ninth aspect of the present invention, electrical signals are fed to the gap between the first and second feeding electrodes. For this purpose, various methods can be used. For example, parallel lines can be extended from the insulator side face and connected to the vertex regions of both the feeding electrodes.

The first and second feeding electrodes may be formed on the internal surfaces of the first and second concavities by plating or the like. The first and second low-conductivity members may be constituted of rubber or elastomer containing conductor.

The first and second low-conductivity members filled in the first and second concavities may be provided with multilayer structure wherein members different in conductivity are respectively filled. At this time, the low-conductivity members are so distributed that the conductivity is lower on the base side of the concavities. Thus, the effect of diminishing reflective power to the feeding portion is enhanced, and this results in expanded matching band.

Other objects, features, and advantages of the present invention will be apparent from the following embodiments of the present invention and the more detailed description taken in connection with the accompanying drawings.

BEST MODE FOR CARRYING OUT THE INVENTION

Figure 1:
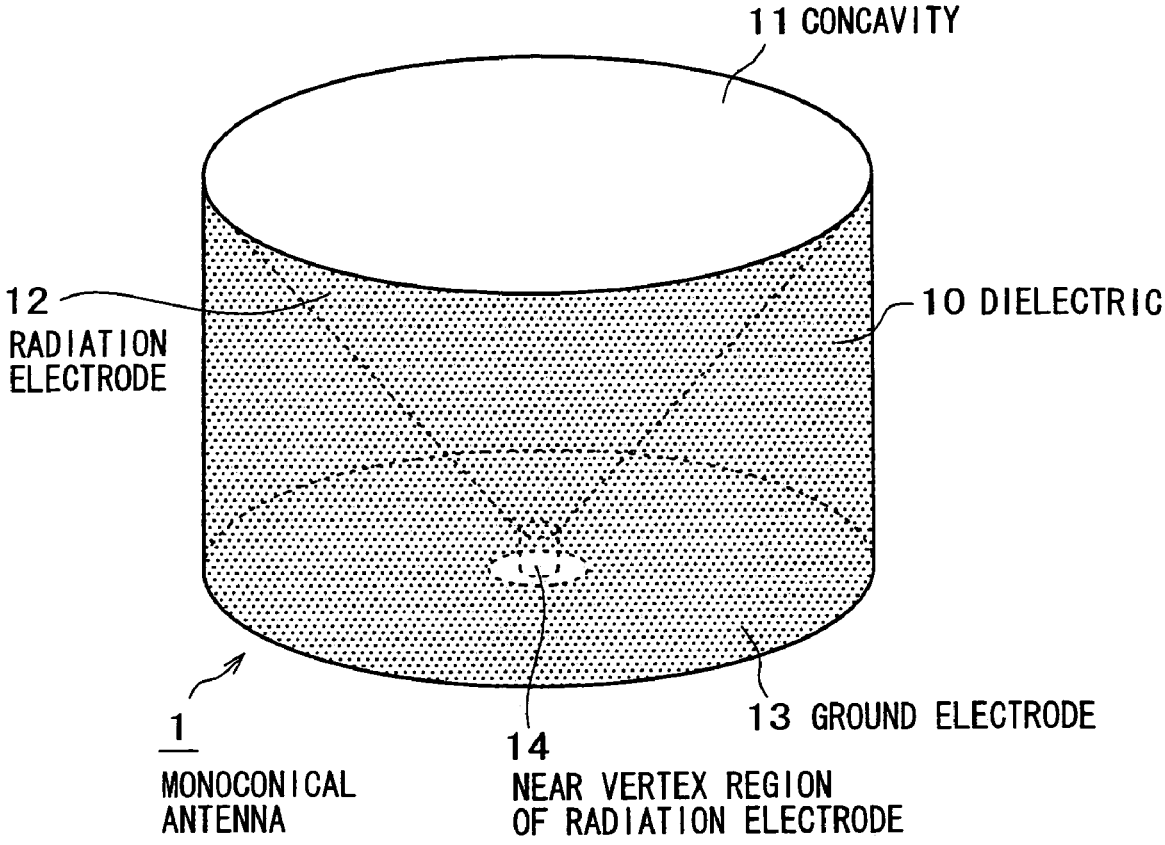
FIG. 1 is a drawing illustrating the appearance and constitution of the monoconical antenna 1 according to a first embodiment of the present invention.

Referring to the drawings, the embodiments of the present invention will be described in detail below.

First Embodiment

FIG. 1 illustrates the appearance and constitution of the monoconical antenna 1 according to the first embodiment of the present invention.

As illustrated in the figure, the monoconical antenna 1 comprises: a substantially conical concavity 11 formed in one end face of a dielectric cylinder 10; a radiation electrode 12 provided on the surface of the concavity; and a ground conductor 13 which is provided in proximity to and substantially in parallel with the other end face opposite the one end face of the dielectric 10. The monoconical antenna 1 is so constituted that electrical signals are fed to between the near vertex region 14 of the radiation electrode 12 and the region of the ground conductor 13.

With respect to the half-cone angle $\alpha$ (angle between the central axis and the side face of the cone) of the substantially conical concavity 11 formed in the one end face of the dielectric 10, the monoconical antenna 1 according to this embodiment is constituted as follows: the half-cone angle $\alpha$ is determined by a predetermined rule according to relative dielectric constant $\in_r$. The rule is, for example, as follows:

(1) If the monoconical antenna 1 is covered with a dielectric with the relative dielectric constant $\in_r=2$, the monoconical antenna 1 is so constituted that the half-cone angle is approximately 45 degrees.

(2) If the monoconical antenna 1 is covered with a dielectric with the relative dielectric constant $\in_r=3$, the monoconical antenna 1 is so constituted that the half-cone angle is approximately 37 degrees.

(3) If the monoconical antenna 1 is covered with a dielectric with the relative dielectric constant $\in_r=5$, the monoconical antenna 1 is so constituted that the half-cone angle is approximately 28 degrees.

(4) If the monoconical antenna 1 is covered with a dielectric with the relative dielectric constant $\in_r=8$, the monoconical antenna 1 is so constituted that the half-cone angle is approximately 23 degrees.

The rule on which the abvoe constitution of the monoconical antenna 1 is based is Expression (1) below. Expression (1) describes the relation between the half-cone angle $\alpha$ of the conical concavity 11 formed in one end face of the dielectric 10 and relative dielectric constant $\in_r$.

$$\alpha=0.8\cdot\tan^{-1}(1.7/\in_r)+13 \text{ (Unit of angle: degree)} \quad (1)$$

The effective range of half-cone angle setting is between the value given by Expression (1) above plus several degrees and minus several degrees. Any value within this range does not pose a problem in practical use.

With the above-mentioned constitution of monoconical antenna, the bandwidth of an antenna is dramatically enhanced.

Figure 2:
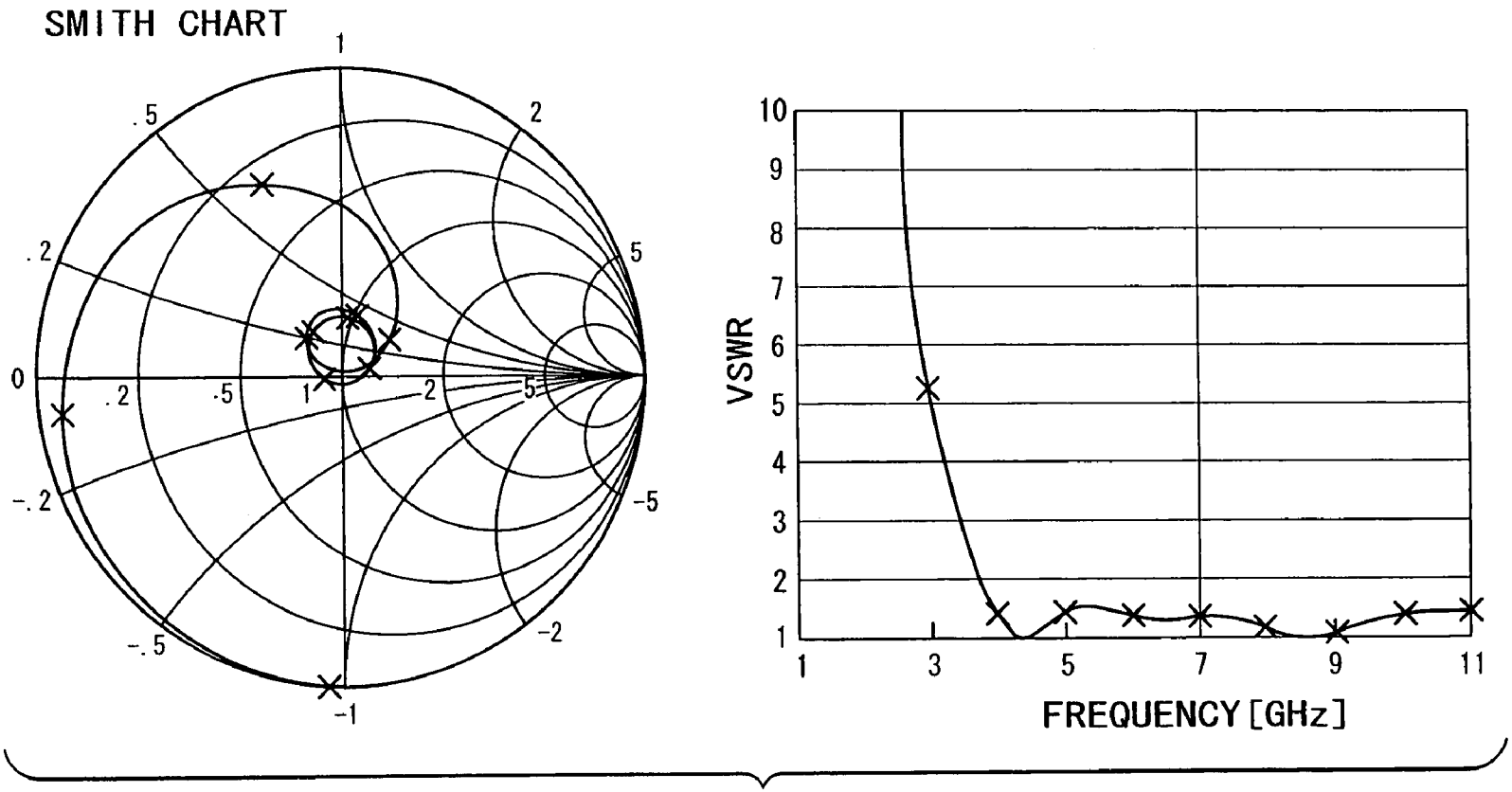
FIG. 2 is a drawing illustrating an example of computation (result of electromagnetic field simulation) of the frequency characteristics of the monoconical antenna based on the constitution according to the first embodiment of the present invention.
Figure 3:
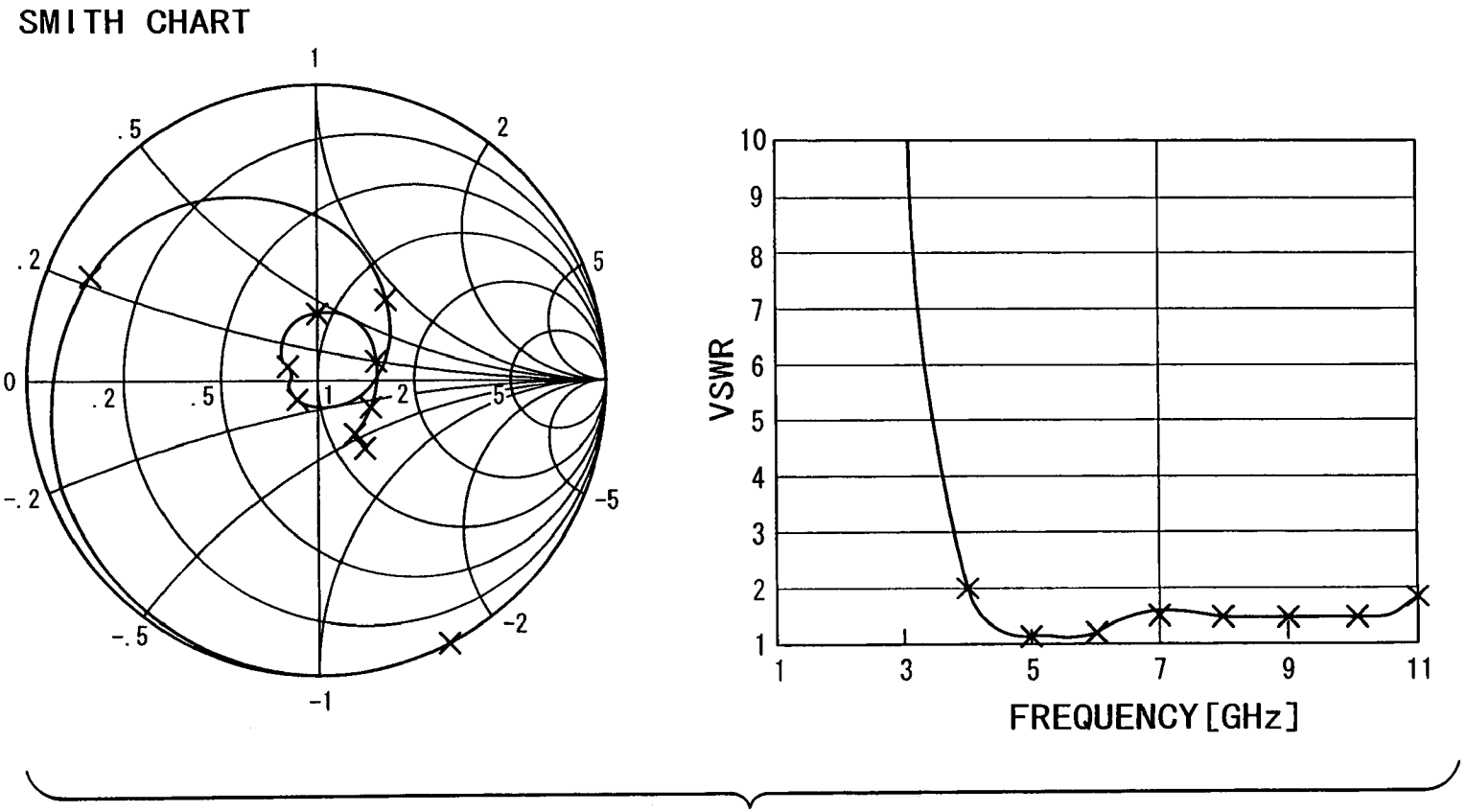
FIG. 3 is a drawing illustrating another example of computation (result of electromagnetic field simulation) of the frequency characteristics of the monoconical antenna based on the constitution according to the first embodiment of the present invention.

FIG. 2 and FIG. 3 illustrate examples of computations of the frequency characteristics of a monoconical antenna according to this embodiment (the results of electromagnetic field simulations). FIG. 2 illustrates the frequency characteristics in the form of Smith chart (center: 50 Ω) and VSWR characteristic diagram which frequency characteristics are measured when the relative dielectric constant $\in_r$ is 3 and the half-cone angle is 40 degrees. FIG. 3 illustrates them measured when the relative dielectric constant $\in_r$ is 8 and the half-cone angle is 22 degrees.

In either example of constitution, the antenna has spiral characteristics in proximity to the center of the Smith chart, and obtains favorable frequency characteristics. It is said that an antenna 1 has favorable antenna characteristics in the frequency domain in which VSWR is not more than 2. In either example of constitution, the relative bandwidth with VSWR≦2 accounts for nearly 100%. It is apparent that the bandwidth is dramatically enhanced as compared with examples of characteristics presented in Japanese Unexamined Patent Publication No. Hei 8(1996)-139515.

With respect to the method for constituting the monoconical antenna according to this embodiment, the shape of the concavity 11 formed in one end face of the dielectric 10 is not limited to circular cone. Even if it is formed in the shape of elliptic cone or pyramid, the effect of the present invention is equally produced. If pyramidal concavity is used, the definition of its half-cone angle $\alpha$ is as follows: the average of the minimum angle and the maximum angle among angles formed between the central axis and the side face."

There is no special limitation on the outside shape of the dielectric cylinder 10 as well. Basically, any shape, including circular cylinder and prism, is acceptable as long as the radiation electrode is covered with it. The radiation electrode may be formed by filling it in the conical concavity 11, instead of forming it on the surface of the concavity 11.

The effective range of the relative dielectric constant $\in_r$ of the dielectric 10 is up to 10 or so.

The present inventors carried out electromagnetic field simulations and approximately derived Expression (1) above, on which a setting of the half-cone angle $\alpha$ of the circular cone formed in the one end face of the dielectric is based. From the results of several simulations, the present inventors found the following: as illustrated in FIG. 4 to FIG. 7, the half-cone angle value which brings optimum matching of the circular cone formed in one end face of a dielectric depends on the relative dielectric constant $\in_r$ of the dielectric covered. An approximated curve significant from the viewpoint of design is obtained by approximately formulating an approximate expression and adjusting its coefficients. With respect to FIG. 4 to FIG. 7, additional description will be given below.

Figure 4:
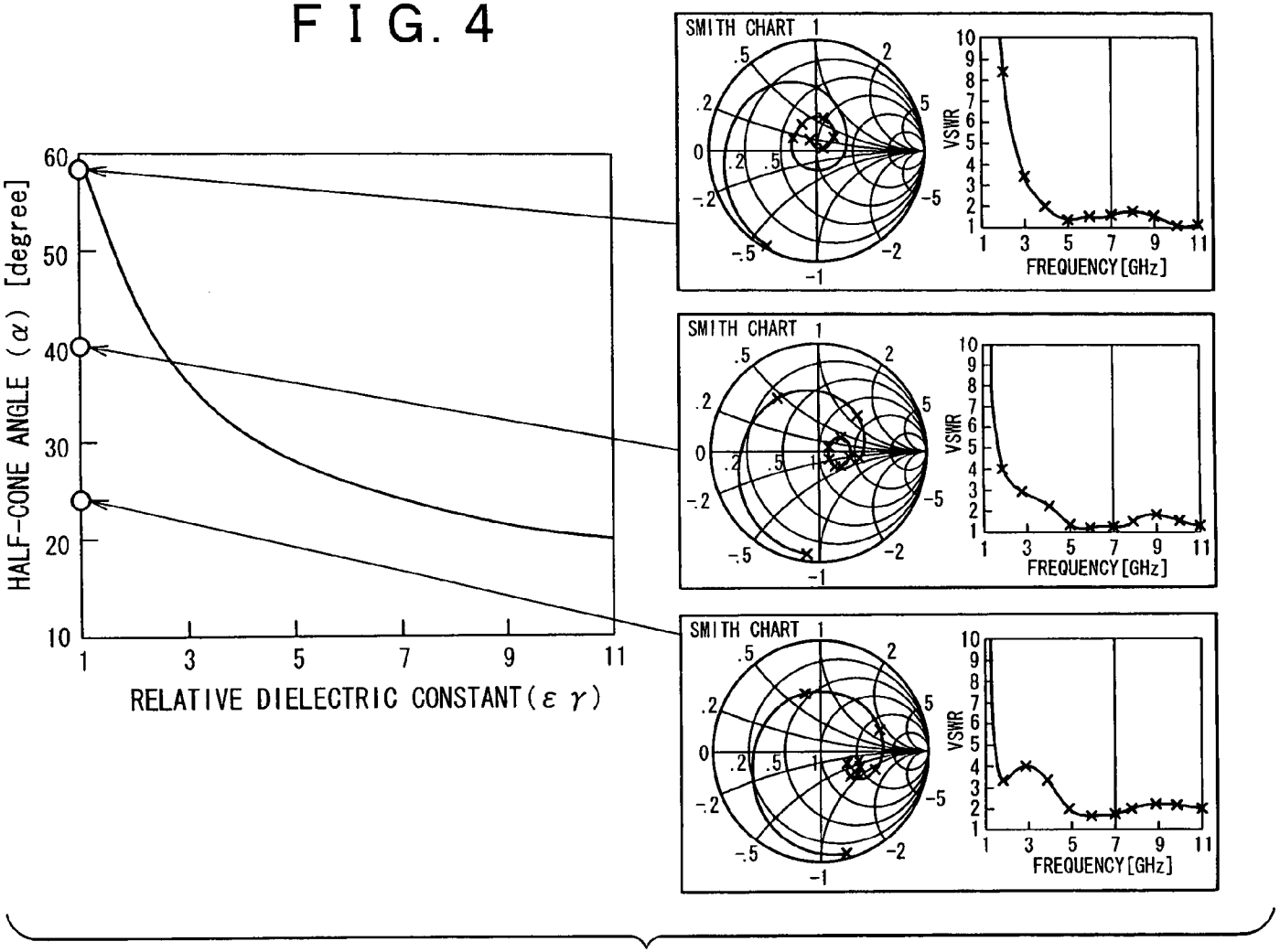
FIG. 4 is a drawing including charts and graphs illustrating half-cone angle versus frequency characteristics (right) and a graph plotted by an expression for setting half-cone angle according to the present invention (left). The figure illustrates the relation between them when the relative dielectric constant $\in_r$ of the dielectric 10 is 1.

FIG. 4 includes charts and graphs illustrating half-cone angle versus frequency characteristics (right) and a graph plotting the half-cone angle based on the expression for setting according to the present invention (left). (The right charts and graphs illustrate three cases: case where the half-cone angle is 58 degrees, case where the half-cone angle is 40 degrees, and case where the half-cone angle is 24 degrees, from above.) The figure illustrates the relation between them when the relative dielectric constant $\in_r$ of the dielectric 10 is 1. The frequency characteristic diagrams comprise Smith chart and VSWR characteristic diagram.

From the frequency characteristic diagrams on the right of the figure, the following is evident: when the half-cone angle is approximately 58 degrees, the Smith chart has a spiral in proximity to the center, and the relative bandwidth with VSWR≦2 is maximized. That is, the following is evident: the half-cone angle which brings optimum matching is 58 degrees, and further that half-cone angle value is very close to the line plotted by the expression for setting half-cone angle according to the present invention.

Figure 5:
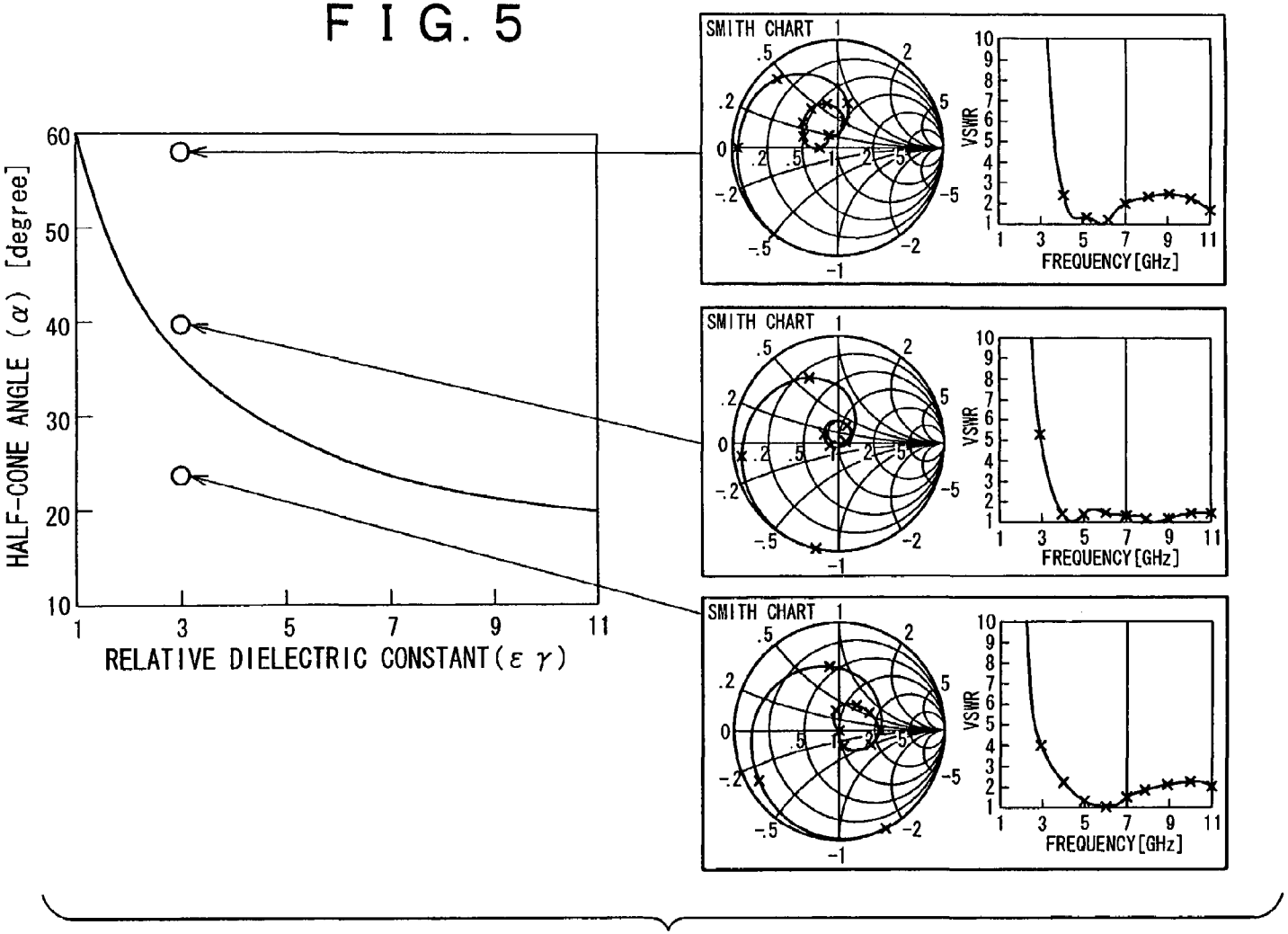
FIG. 5 is another drawing including charts and graphs illustrating half-cone angle versus frequency characteristics (right) and a graph plotted by the expression for setting half-cone angle according to the present invention (left). The figure illustrates the relation between them when the relative dielectric constant $\in_r$ of the dielectric 10 is 3.

FIG. 5 includes charts and graphs illustrating half-cone angle versus frequency characteristics (right) and a graph plotting the half-cone angle based on the expression for setting according to the present invention (left). (The right charts and graphs illustrate three cases: case where the half-cone angle is 58 degrees, case where the half-cone angle is 40 degrees, and case where the half-cone angle is 24 degrees, from above.) The figure illustrates the relation between them when the relative dielectric constant $\in_r$ of the dielectric 10 is 3. The frequency characteristic diagrams comprise Smith chart and VSWR characteristic diagram.

From the frequency characteristic diagrams on the right of the figure, the following is evident: when the half-cone angle is approximately 40 degrees, the Smith chart has a spiral in proximity to the center, and the relative bandwidth with VSWR≦2 is maximized. That is, the following is evident: the half-cone angle which brings optimum matching is 40 degrees, and further that half-cone angle value is very close to the line plotted by the expression for setting half-cone angle according to this embodiment.

Figure 6:
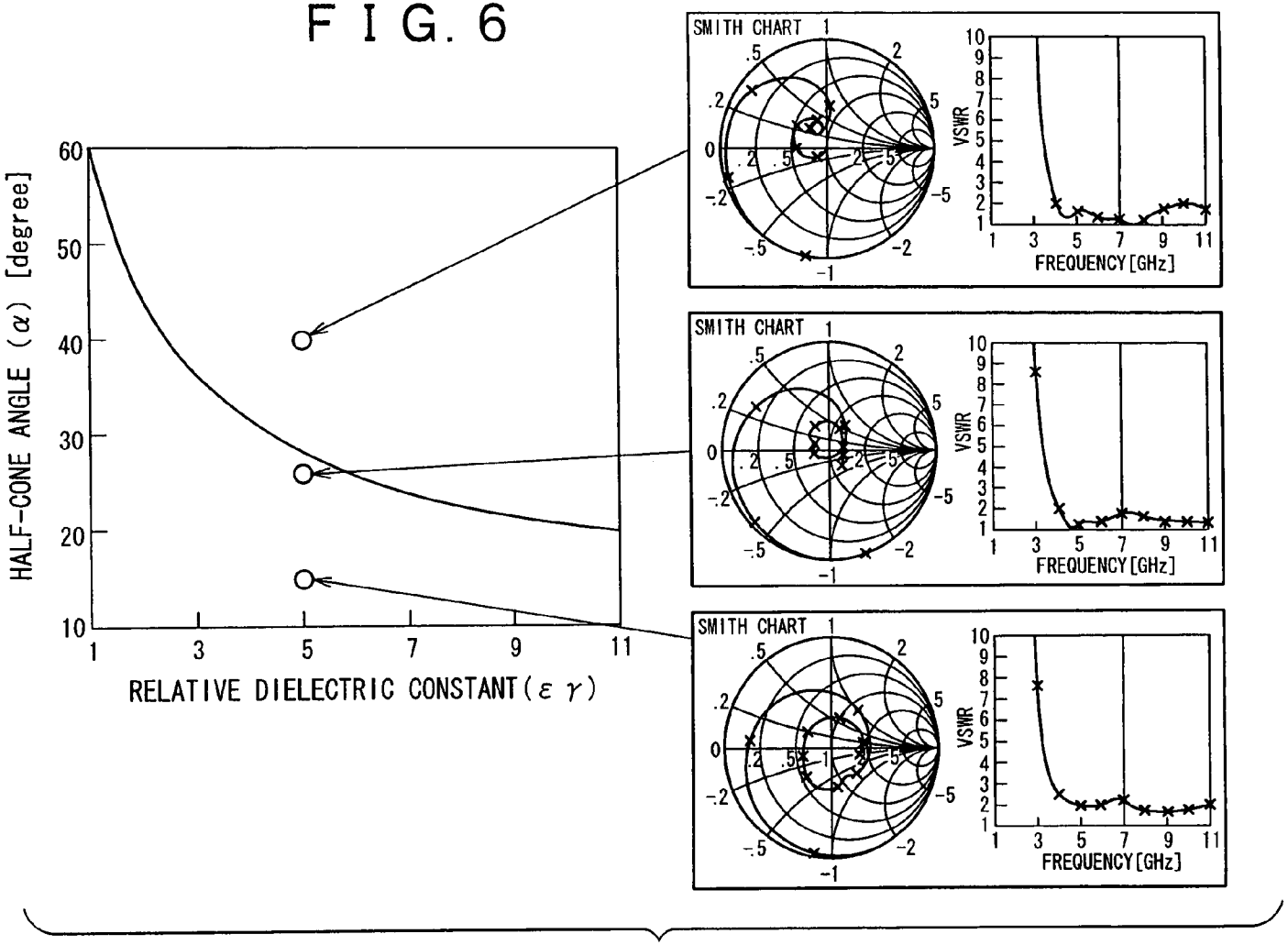
FIG. 6 is a further drawing including charts and graphs illustrating half-cone angle versus frequency characteristics (right) and a graph plotted by the expression for setting half-cone angle according to the present invention (left). The figure illustrates the relation between them when the relative dielectric constant $\in_r$ of the dielectric 10 is 5.

FIG. 6 includes charts and graphs illustrating half-cone angle versus frequency characteristics (right) and a graph plotting the half-cone angle based on the expression for setting according to the present invention (left). (The right charts and graphs illustrate three cases: case where the half-cone angle is 40 degrees, case where the half-cone angle is 26 degrees, and case where the half-cone angle is 15 degrees, from above.) The figure illustrates the relation between them when the relative dielectric constant $\in_r$ of the dielectric 10 is 5. The frequency characteristic diagrams comprise Smith chart and VSWR characteristic diagram.

From the frequency characteristic diagrams on the right of the figure, the following is evident: when the half-cone angle is approximately 26 degrees, the Smith chart has a spiral in proximity to the center, and the relative bandwidth with VSWR≦2 is maximized. That is, the following is evident: the half-cone angle which brings optimum matching is 26 degrees, and further that half-cone angle value is very close to the line plotted by the expression for setting half-cone angle according to the present invention.

Figure 7:
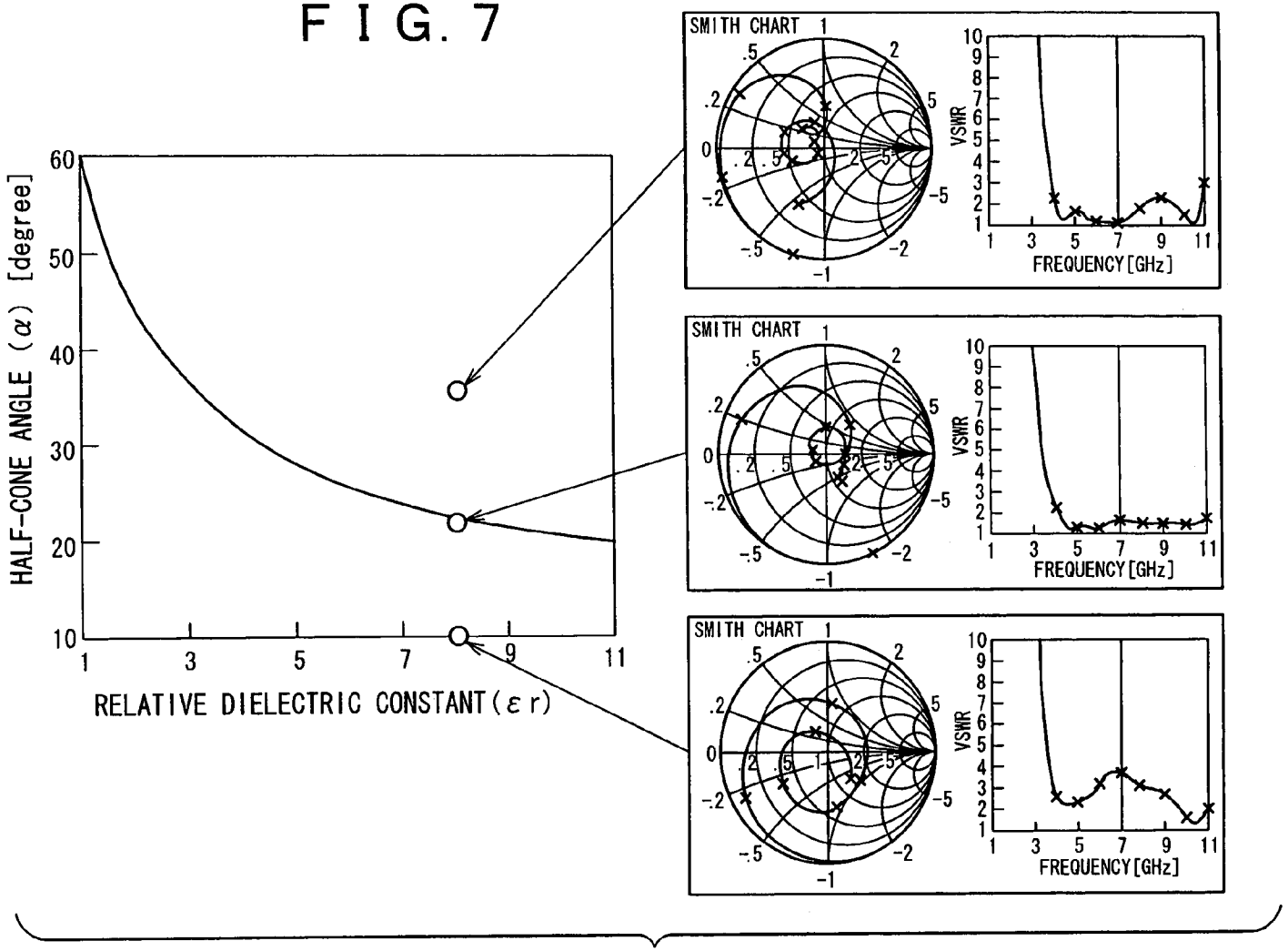
FIG. 7 is a further drawing including charts and graphs illustrating half-cone angle versus frequency characteristics (right) and a graph plotted by the expression for setting half-cone angle according to the present invention (left). The figure illustrates the relation between them when the relative dielectric constant $\in_r$ of the dielectric 10 is 8.

FIG. 7 includes charts and graphs illustrating half-cone angle versus frequency characteristics (right) and a graph plotting the half-cone angle based on the expression for setting according to the present invention (left). (The right charts and graphs illustrate three cases: case where the half-cone angle is 36 degrees, case where the half-cone angle is 22 degrees, and case where the half-cone angle is 10 degrees, from above.) The figure illustrates the relation between them when the relative dielectric constant r of the dielectric 10 is 8. The frequency characteristic diagrams comprise Smith chart and VSWR characteristic diagram.

From the frequency characteristic diagrams on the right of the figure, the following is evident: when the half-cone angle is approximately 22 degrees, the Smith chart has a spiral in proximity to the center, and the relative bandwidth with VSWR≦2 is maximized. That is, the following is evident: the half-cone angle which brings optimum matching is 22 degrees, and further that half-cone angle value is very close to the line plotted by the expression for setting half-cone angle according to this embodiment.

Second Embodiment

The monoconical antenna comprises a substantially conical concavity formed in one end face of a dielectric cylinder; a radiation electrode provided on the surface of the concavity (or provided so that the concavity is filled with it); and a ground conductor provided in proximity to and substantially in parallel with the other end face opposite the one end face of the dielectric. The monoconical antenna is so constituted that electrical signals are fed to between the near vertex region of the radiation electrode and the region of the ground conductor. The monoconical antenna can be constituted as a small antenna having relatively wideband characteristics because of the wavelength shorting effect from the dielectric positioned between the radiation electrode and the ground electrode.

The present inventors found that a setting of the half-cone angle of a monoconical antenna has great influence on impedance matching band. Then, the present inventors derived the following: the impedance matching band can be maximized by determining the half-cone angle $\alpha$ (angle formed between the central axis and the side face of a cone) of a conical concavity formed in one end face of a dielectric by the following expression which describes its relation with relative dielectric constant $\in_r$:

$$\alpha=0.8\cdot\tan^{-1}(1.7/\in_r)+13 \text{ (Unit of angle: degree)} \quad (2)$$

Figure 8:
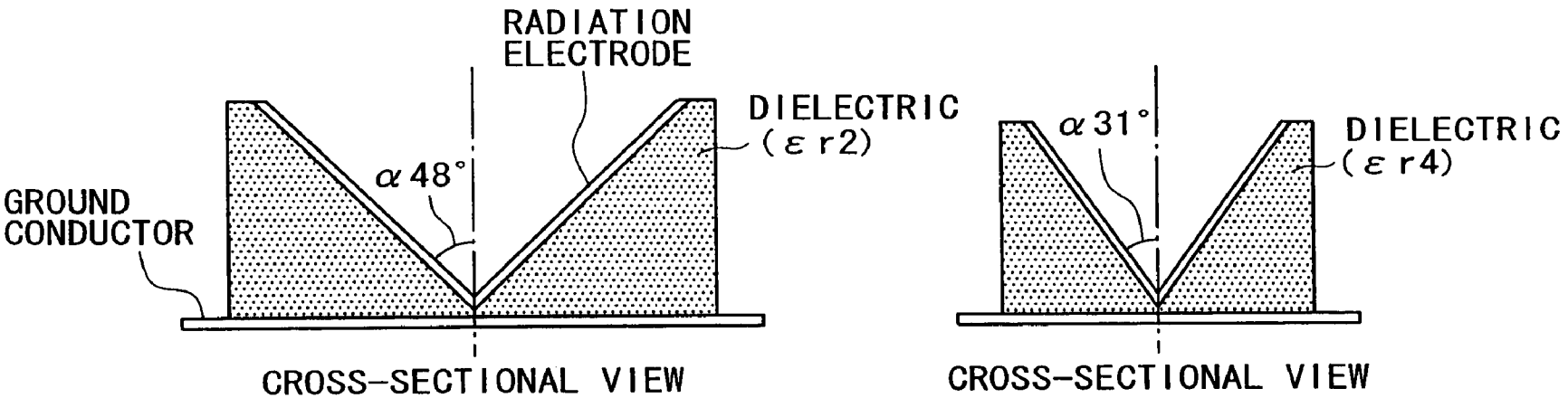
FIG. 8 is a drawing illustrating the constitutions of monoconical antennas so constituted that the half-cone angle $\alpha$ of the substantially conical concavity formed in one end face of a dielectric is in accordance with a predetermined rule corresponding to relative dielectric constant $\in_r$.
Figure 9:
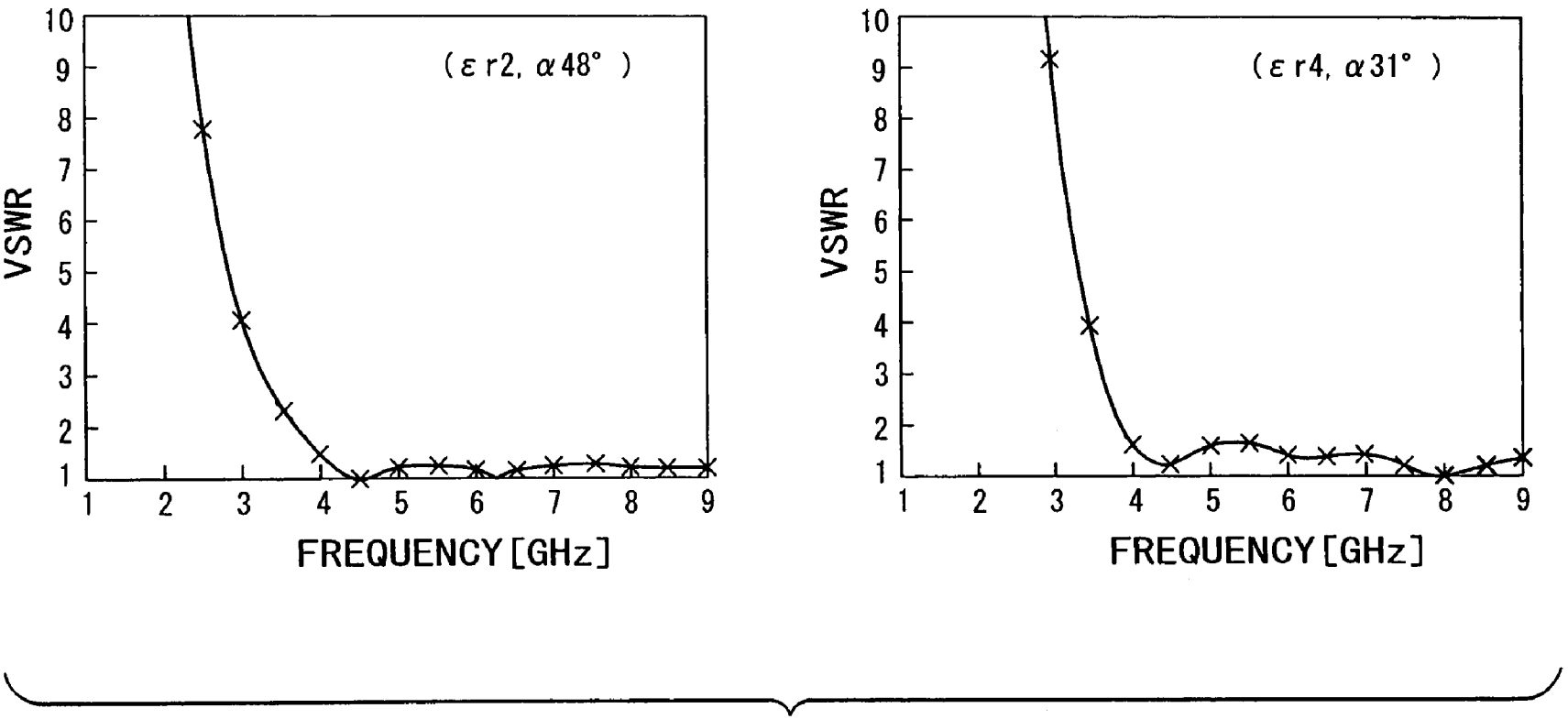
FIG. 9 is drawings illustrating the antenna characteristics of a monoconical antenna with the optimum half-cone angle for the relative dielectric constant $\in_r$ of 2 and 4, respectively.

That is, the optimum half-cone angle of a circular cone depends on the relative dielectric constant of the dielectric. As illustrated in FIG. 8, for example, the optimum half-cone angle is 48 degrees when the relative dielectric constant $\epsilon_r$ is 2, and 31 degrees when the relative dielectric constant $\in_r$ is 4. FIG. 9 illustrates the antenna characteristics of a monoconical antenna with an optimum half-cone angle for the relative dielectric constant $\in_r$ of 2 and 4, respectively. However, the figure represents the antenna characteristics by VSWR characteristics. From FIG. 9, the following is evident: favorable impedance matching is obtained over an ultra-wide band by designing the monoconical antenna based on Expression (2) above which describes the relation between the relative dielectric constant r and the optimum half-cone angle $\alpha$ of the concavity.

In the monoconical antenna constituted based on Expression (2) above, its side face is covered with a dielectric; therefore, the effect of miniaturization is inevitably produced. (This is caused by that the wavelength of the electromagnetic field produced between the radiation electrode and the ground conductor is shortened.) In packaging, therefore, a relative dielectric constant, that is, a dielectric is appropriately selected to meet requests for miniaturization, and then a half-cone angle of the circular cone is determined.

With the constitution of the monoconical antenna based on Expression (2) above, reduction in the size of the antenna can be accomplished by enhancing the relative dielectric constant $\in_r$ of the dielectric. However, in conjunction with this, the half-cone angle $\alpha$ is also reduced (that is, the antenna becomes longer than is wide). Therefore, the height of the antenna is not extremely reduced. As a matter of fact, low profile is often requested.

Extremely slender constitution may be conversely desired sometimes. If a monoconical antenna is constituted according to Expression (2) above, this is accomplished by enhancing the relative dielectric constant $\in_r$. As a matter of fact, however, dielectrics of various relative dielectric constants do not infinitely exist. Further, available dielectrics are naturally limited in terms of workability in electrode formation and cutting and heat resistance. Therefore, a desired slender constitution is quite likely to be difficult to implement.

The half-cone angle of a circular cone whose profile or width is reduced deviates from an optimum value which brings favorable impedance matching. To cope with this, this embodiment is so constituted that it is compensated by stepping the half-cone angle.

More specific description will be given. If low-profile constitution is adopted, the half-cone angle is varied stepwise so that it is reduced as it goes from the base portion to the vertex portion. However, the ratio of the height h of the concavity to the effective radius r of the base of the concavity is set in accordance with the following expression which describes its relation with relative dielectric constant $\in_r$.

$$\tan^{-1}(r/h)>0.8\cdot\tan^{-1}(1.7/\epsilon_r)+13 \text{ (Unit of angle: degree)} \quad (3)$$

If slender constituion is adopted, the half-cone angle is varied so that it is increased as it goes from the base portion to the vertex portion. However, the ratio of the height h of the concavity to the effective radius r of the base of the concavity is set in accordance with the following expression which describes its relation with relative dielectric constant $\in_r$.

$$\tan^{-1}(r/h)<0.8\cdot\tan^{-1}(1.7/\in_r)+13 \text{ (Unit of angle: degree)} \quad (4)$$

In either case of low-profile constitution and slender constitution, two steps of half-cone angle are basically sufficient. Needless to add, the number of steps may be increased to three or more, or a portion where the half-cone angle is continuously varied may be present. However, the half-cone angle at the vertex portion of a radiation electrode must be less than 90 degrees. Further, it is preferable that variation in half-cone angle should be gentle in proximity to the vertex portion of a radiation electrode. It follows that an effort should be made to maintain an equiangular circular cone in proximity to the vertex portion, that is, the feeding portion in accordance with Rumsey's Equiangular Theory. (For Rumsey's Equiangular Theory, refer to "Frequency Independent Antenna," written by V. Rumsey (Academic Press, 1966)). Care must be taken not to depart from the above principle. Otherwise, the ultra-wideband characteristics inherent in the monoconical antenna can be lost.

Figure 10:
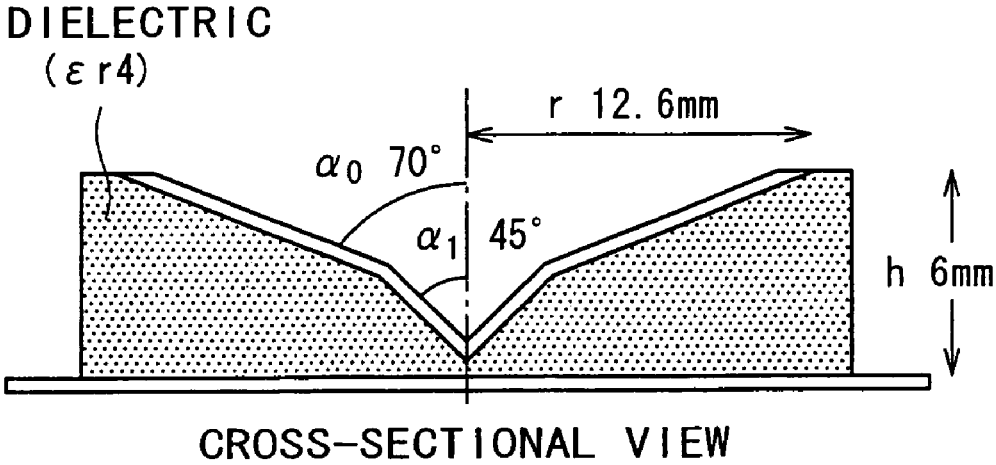
FIG. 10 is a drawing illustrating an example of a monoconical antenna whose profile is reduced as compared with the optimum half-cone angle constitution.

FIG. 10 illustrates an example of a monoconical antenna whose profile is reduced as compared with optimum half-cone angle constitution according to the present invention. In the example illustrated in the figure, the profile is lower than in the optimum half-cone angle constitution. In this example, a dielectric with a relative dielectric constant $\in_r$ of 4 is selected; the height h of the circular cone is set to 6 mm; and the radius r of the base of the circular cone is set to 12.6 mm. Thus, as a natural consequence, the relation expressed by Expression (3) above holds.

As illustrated in the figure, further, two step constitution is adopted. With this constitution, the half-cone angle is stepped at a midpoint, and the half-cone angle value $\alpha_0$ on the base side is set to 70 degrees with the half-cone angle value $\alpha_1$ on the vertex side set to 45 degrees. Thus, the half-cone angle value on the vertex side is made smaller than that on the base side.

Figure 11:
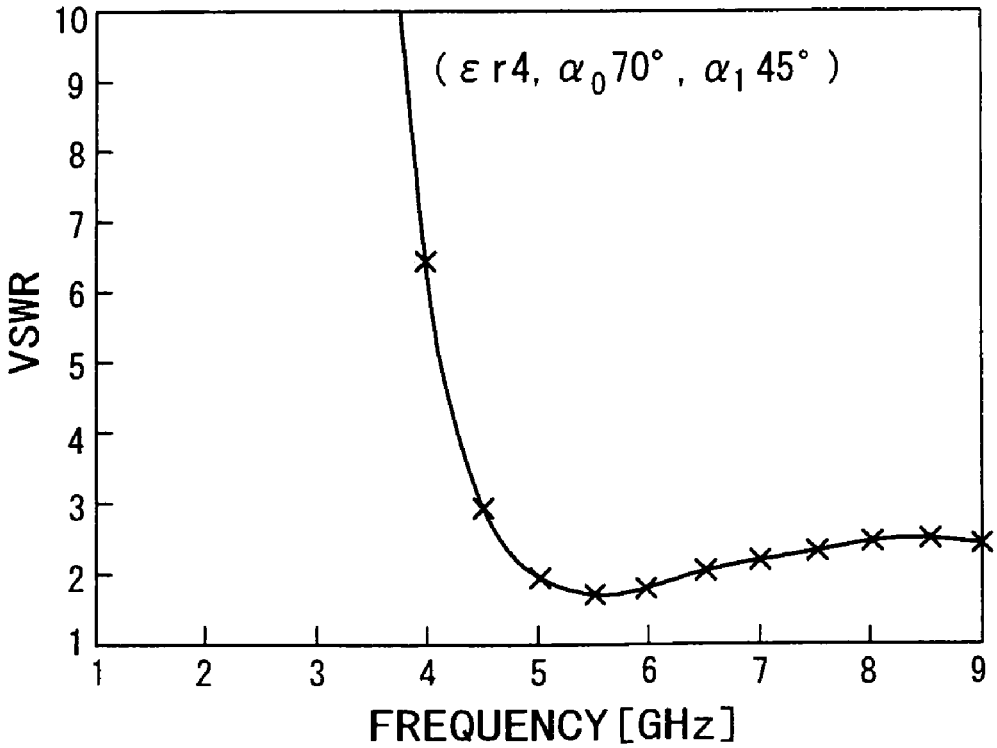
FIG. 11 is a drawing illustrating the VSWR characteristics of a monoconical antenna having the constitution illustrated in FIG. 10.

FIG. 11 illustrates the result of a simulation conducted with respect to the VSWR characteristics of a monoconical antenna having the constitution illustrated in FIG. 10. As illustrated in the figure, favorable impedance matching is generally obtained, and a state in which the impedance matching is greatly lost and thus wideband characteristics are lost is avoided. If the combination of half-cone angle values is more finely adjusted, more favorable characteristics would be obtained.

Figure 12:
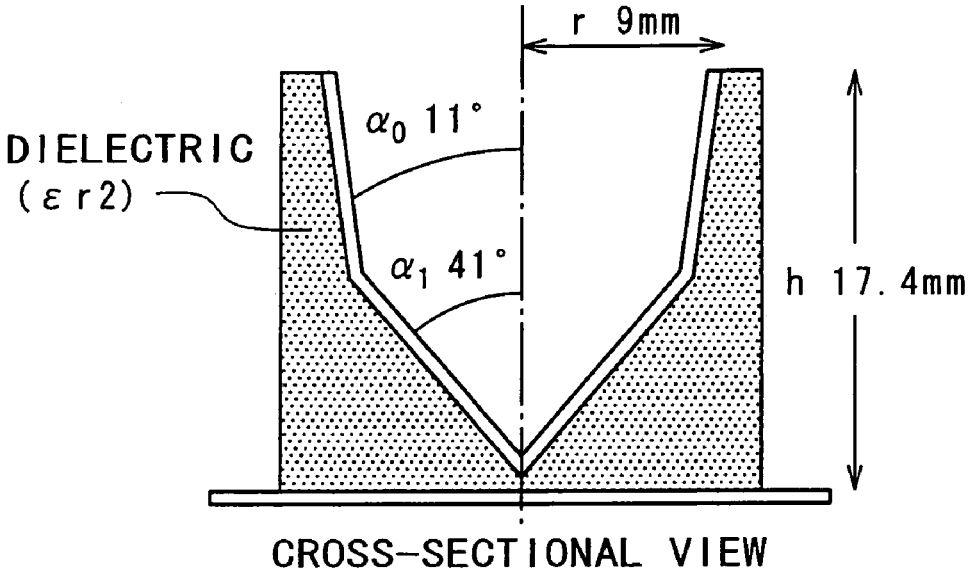
FIG. 12 is a drawing illustrating an example of a monoconical antenna whose width is reduced as compared with the optimum half-cone angle constitution according to the present invention.

FIG. 12 illustrates an example of a monoconical antenna whose width is reduced as compared with optimum half-cone angle constitution according to this embodiment. In the example illustrated in the figure, the width is smaller than the optimum half-cone angle constitution. In this example, a dielectric with a relative dielectric constant $\in_r$ of 2 is selected; the height h of the circular cone is set to 17.4 mm; and the radius r of the base of the circular cone is set to 9 mm. Thus, as a natural consequence, the relation expressed by Expression (4) above holds.

As illustrated in the figure, further, two step constitution is adopted. With this constitution, the half-cone angle is stepped at a midpoint, and the half-cone angle value $\alpha_0$ on the base side is set to 11 degrees with the half-cone angle value $\alpha_1$ on the vertex side is set to 41 degrees. Thus, the half-cone angle value on the vertex side is made larger than that on the base side.

Figure 13:
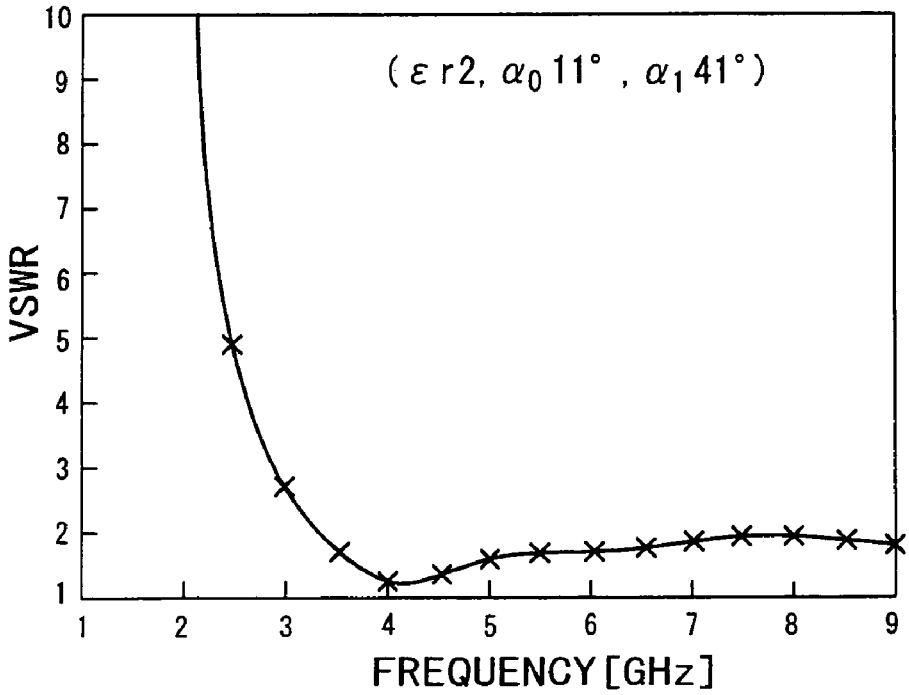
FIG. 13 is a drawing illustrating the VSWR characteristics of a monoconical antenna having the constitution illustrated in FIG. 12.

FIG. 13 illustrates the result of a simulation conducted with respect to the VSWR characteristics of a monoconical antenna having the constitution illustrated in FIG. 12. As illustrated in the figure, favorable impedance matching is generally obtained.

Figure 14:
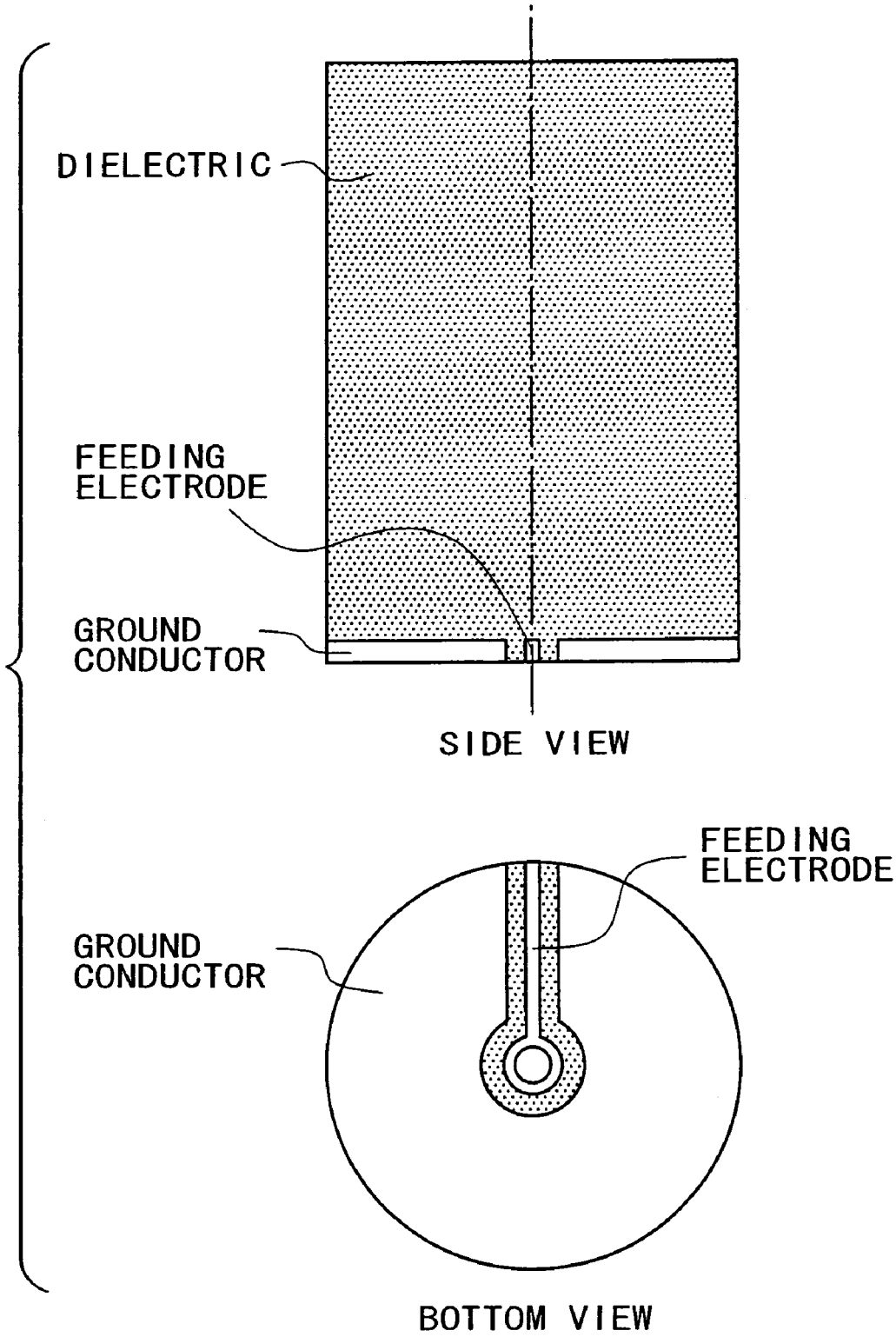
FIG. 14 is a drawing illustrating an example of the constitution of a monoconical antenna provided with a feeding portion structure suitable for mass production according to the present invention.

FIG. 14 illustrates an example of the constitution of a monoconical antenna provided with a feeding portion structure suitable for mass production.

In the example illustrated in the figure, a track-like feeding electrode is provided on the base of a dielectric, and the feeding electrode and a radiation electrode are electrically connected with each other through a hole made in the center of the bottom of the dielectric. As illustrated in the figure, this feeding electrode is so formed that its one end reaches the dielectric side face.

A ground conductor is also formed on the dielectric base. As illustrated in the figure, the ground conductor is so formed that it averts and encircles the feeding electrode. Further, the ground conductor is also so formed that it is extended to the dielectric side face.

The feeding electrode and ground conductor illustrated in FIG. 14 can be easily formed on the surface of a dielectric by plating, for example. Therefore, use of such a monoconical antenna as illustrated in the figure makes it possible to follow a technique for so-called surface mounting when the antenna is mounted on a circuit board in mass production, and thus the manufacturing process is simplified.

Figure 15:
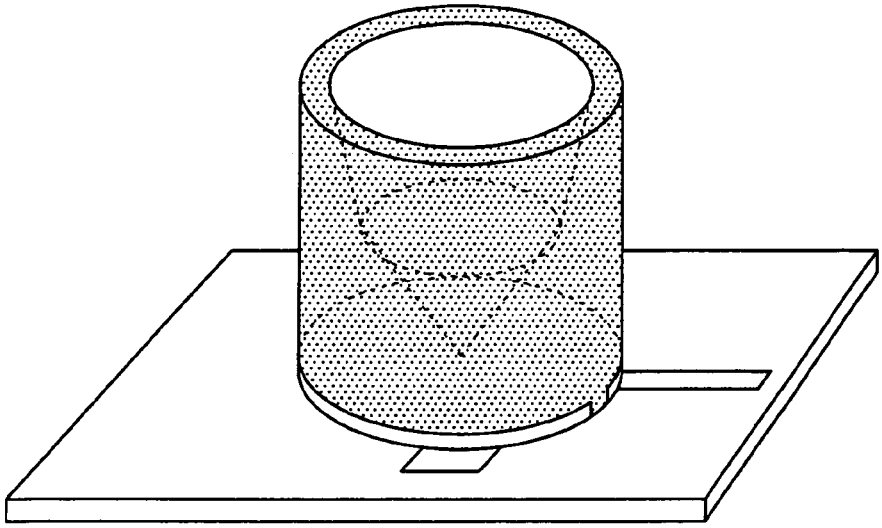
FIG. 15 is a drawing illustrating how a monoconical antenna having the constitution illustrated in FIG. 14 is mounted on a circuit board.

As illustrated in FIG. 15, the body of the monoconical antenna can be fixed on and electrically connected with a circuit board only by soldering the electrodes on the dielectric side face to the electrodes on the circuit board from the surface side.

The ground conductor need not necessarily be formed on the base of a dielectric, and alternatively, a ground conductor may be formed on the circuit board on which the body of the antenna is to be mounted. In this case, for example, adhesive may be used to fix the body of the antenna.

The monoconical antennas according to this embodiment illustrated in FIG. 10 and FIG. 12 are so constituted that: when an antenna is reduced in profile or width based on the optimum values of half-cone angle obtained by Expressions (3) and (4) above, deviation of its half-cone angle from the optimum values is compensated. This compensation is carried out by stepping the half-cone angle, and this results in favorable impedance matching.

If the profile of an antenna is reduced, a problem arises. The half-cone angle of the cone deviates from the optimum value which brings favorable impedance matching. To cope with this, the vertex of the circular cone of the monoconical antenna is set off the center, and impedance matching is thereby compensated. This is a modification to the present invention. In this case, the straight line connecting the vertex of the substantially conical radiation electrode and the center of the base of the cone is not perpendicular to the base of the cone.

Figure 16:
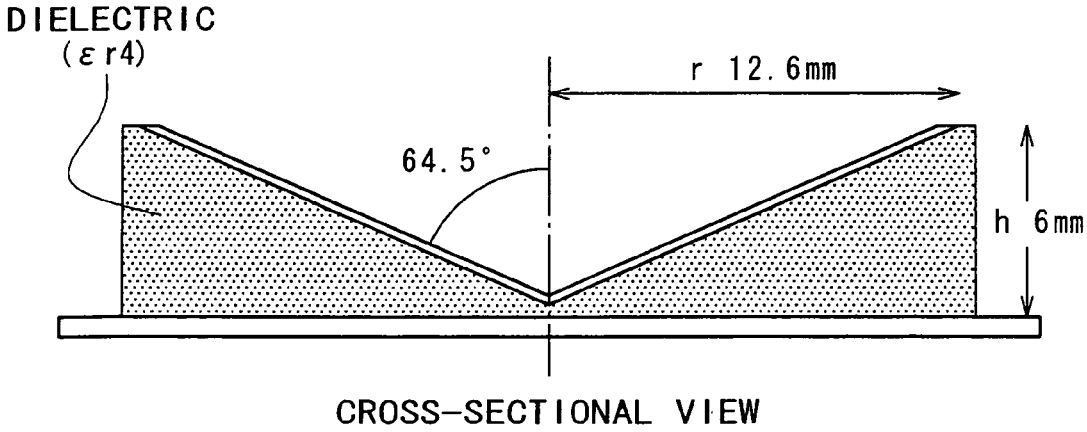
FIG. 16 is a drawing illustrating the cross-sectional structure of a monoconical antenna using low-profile constitution.
Figure 17:
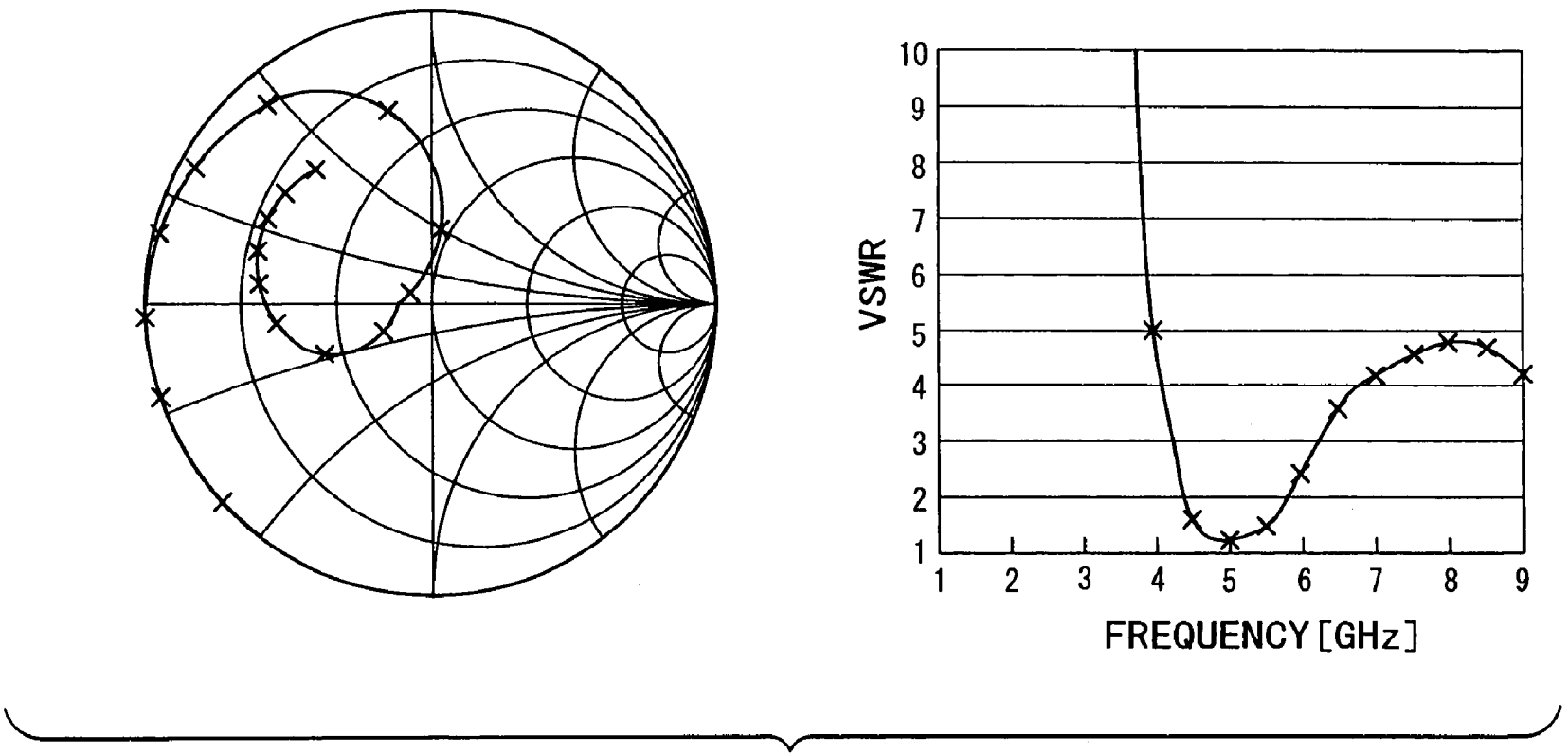
FIG. 17 is the impedance characteristic diagram and VSWR characteristic diagram of the low-profile monoconical antenna illustrated in FIG. 16.

An example will be taken. FIG. 16 illustrates the cross-sectional structure of a monoconical antenna using low-profile constitution. In the example illustrated in the figure, the half-cone angle of the circular cone is 64.5 degrees, which differs from 31 degrees, the optimum value with $\in_r$=4. As dielectric to be filled in the area between the radiation electrode and the ground conductor, a material with a relative dielectric constant $\in_r$ of 4 is used. FIG. 17 includes the impedance characteristic diagram and VSWR characteristic diagram of the low-profile monoconical antenna illustrated in FIG. 16. As is evident from the figure, the impedance greatly differs from 50 ohm, and the VSWR characteristics are impaired, especially, in high frequency domain.

Figure 18:
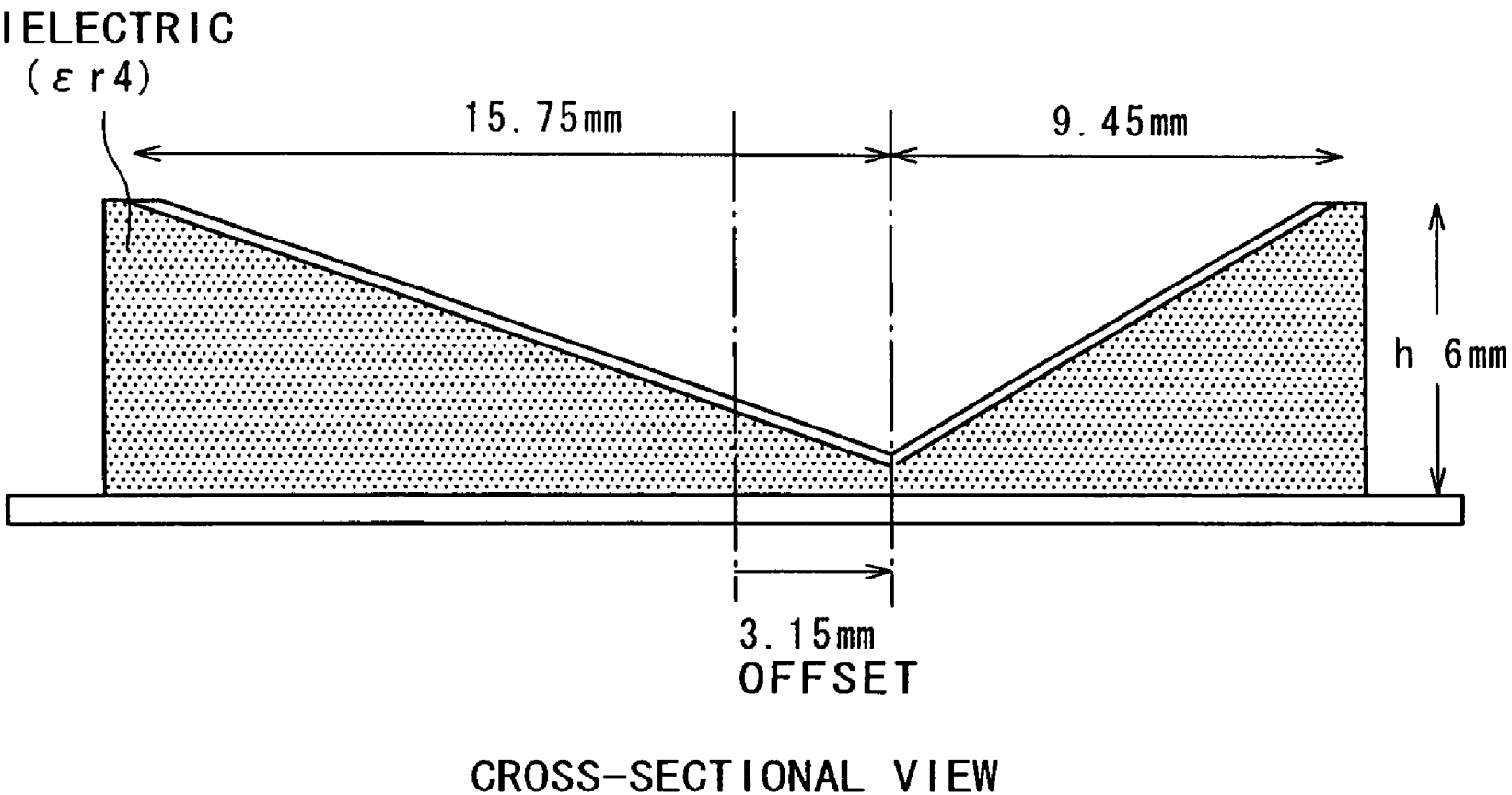
FIG. 18 is a drawing illustrating the cross-sectional structure of a low-profile monoconical antenna wherein the vertex of the conical radiation electrode is set off the center by 25% with respect to radius.

Meanwhile, FIG. 18 illustrates the cross-sectional structure of a low-profile monoconical antenna wherein the vertex of the conical radiation electrode is set off the center by 25% with respect to radius. In this case, as illustrated in the figure, the straight line connecting the vertex of the substantially conical radiation electrode and the base of the cone is not perpendicular to the base of the cone.

Figure 19:
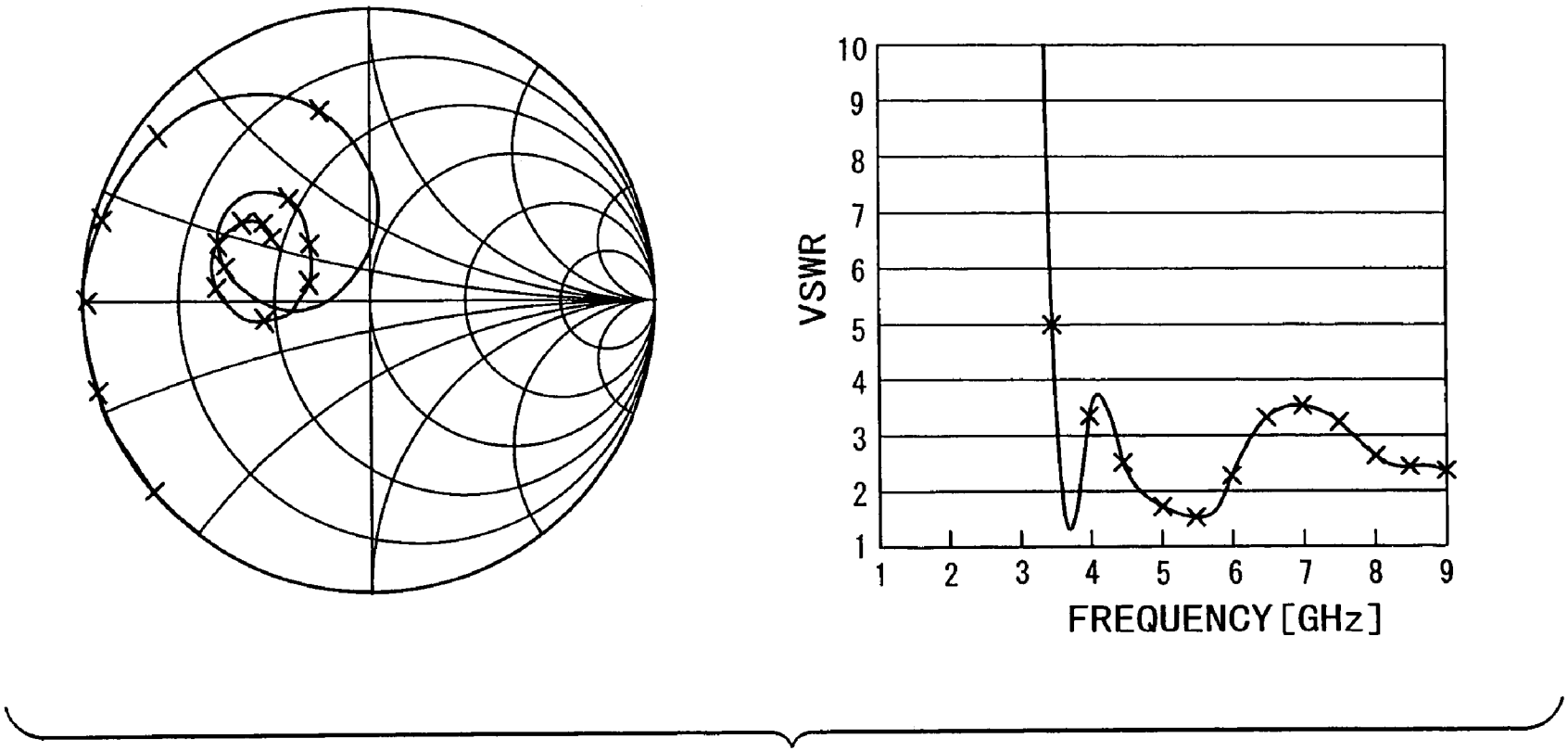
FIG. 19 is the impedance characteristic diagram and VSWR characteristic diagram of the low-profile monoconical antenna illustrated in FIG. 18.

FIG. 19 includes the impedance characteristic diagram and VSWR characteristic diagram of the low-profile monoconical antenna illustrated in FIG. 18. As is evident from the figure, the impedance characteristics are close to 50 ohm, and the VSWR characteristics are enhanced as well. Especially, it is important that the lower limit frequency of the matching band is lowered.

As mentioned above, it is apparent that if the impedance cannot matched in a monoconical antenna due to profile reduction or the like, setting the vertex of the cone off the center is effective as a means for enhancing its characteristics.

Such a low-profile structure as illustrated in FIG. 18 is also applicable when the relative dielectric constant $\in_r$=1, that is, it is applicable to a monoconical antenna wherein no dielectric material is present. Further, the low-profile structure is widely applicable to not only monoconical antennas covered with a dielectric but also ordinary conical antennas (antennas provided with a substantially conical radiation electrode and a ground conductor).

With respect to the method for constituting the monoconical antenna according to this embodiment, the shape of the concavity formed in one end face of the dielectric is not limited to circular cone. Even if it is formed in the shape of elliptic cone or pyramid, the effect of the present invention is equally produced.

If pyramidal concavity is used, the definition of its half-cone angle $\alpha$ is as follows: the average of the minimum angle and the maximum angle among angles formed between the central axis and the side face.

There is no special limitation on the outside shape of the dielectric cylinder as well. Basically, any shape, including circular cylinder and prism, is acceptable as long as the radiation electrode is covered with it. The radiation electrode may be formed by filling it in the conical concavity 11, instead of forming it on the surface of the concavity.

Third Embodiment

Figure 20:
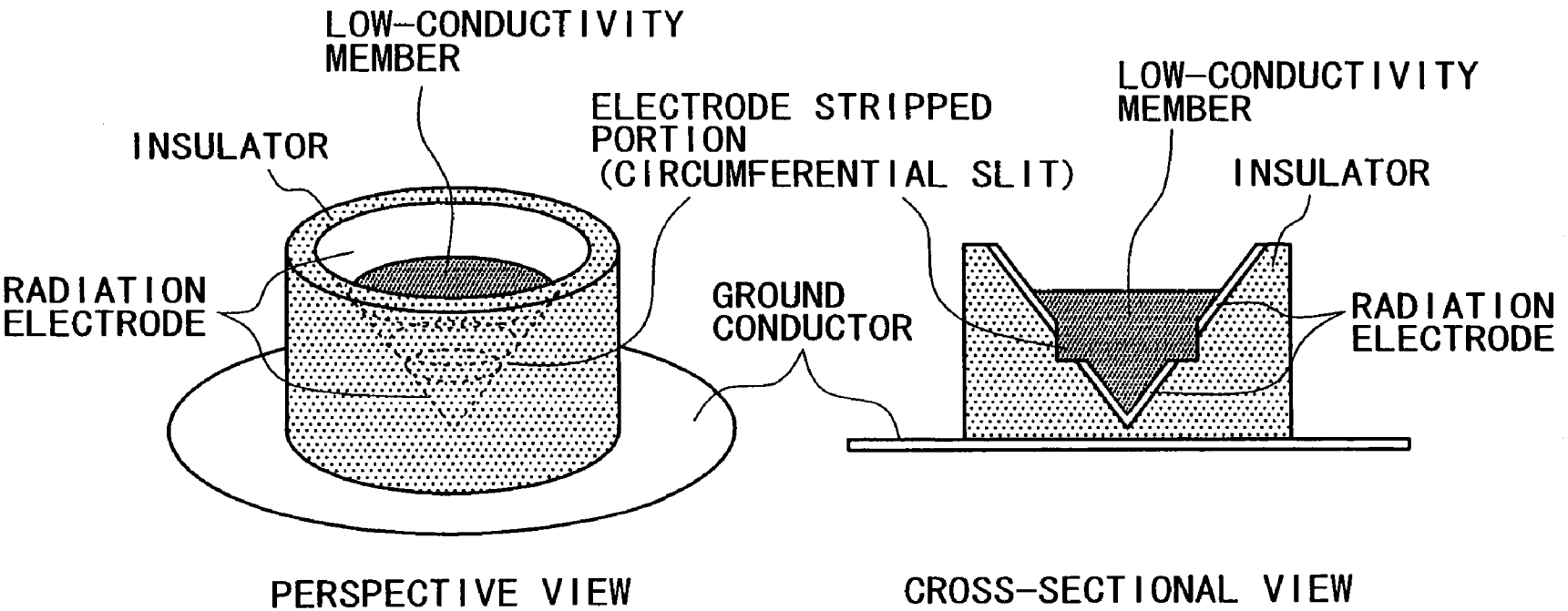
FIG. 20 is a drawing illustrating the constitution of the monoconical antenna according to a third embodiment of the present invention.

FIG. 20 illustrates the constitution of the monoconical antenna according to the third embodiment of the present invention. The monoconical antenna comprises: an insulator; a substantially conical concavity provided in one end face of the insulator; a radiation electrode formed on the internal surface of the concavity; a stripped portion obtained by circumferentially stripping part of the radiation electrode;

a low-conductivity member filled in the concavity to the level at which at least the stripped portion is buried; and a ground conductor provided in proximity to and substantially in parallel with the other end face of the insulator.

First, the substantially conical concavity is provided in the one end face of the insulator. The radiation electrode is formed on the internal surface of the concavity by plating or the like. Subsequently, part of the radiation electrode is circumferentially stripped by cutting or the like. Then, the low-conductivity member is filled to the level at which the stripped portion is buried. For the low-conductivity member, rubber or elastomer containing conductor is suitable. A desired conductivity is obtained with comparative ease by adjusting the conductor content. Further, the ground conductor is provided in proximity to and substantially in parallel with the other end face of the insulator. Needless to add, an electrode may be formed as ground conductor directly on the other end face of the insulator.

As in conventional monoconical antennas, electrical signals are fed to the gap between the radiation electrode and the ground conductor. If electrical signals are fed from the back face side of the ground conductor, the same constitution as conventional antennas may adopted. That is, a hole is made in the ground conductor, and the vertex region of the radiation electrode is extended to the back face side.

The antenna illustrated in FIG. 20 basically functions as a monoconical antenna. By the way, no conductor is present on the upper base of the concavity; however, this does not become a cause of preventing the proper operation of the monoconical antenna. In addition, since the low-conductivity member exists between the two divided radiation electrodes, the electrical effect equivalent to resistive loading is produced. (FIG. 20 is depicted so that the concavity is formed on the upper side of the insulator. However, there are not the conceptions of top and bottom because of the structure of conical antenna. In this specification, the end face provided with the concavity is designated as upper base for convenience in description. However, that does not limit the scope of the present invention. (The is the same with the following.))

Figure 21:
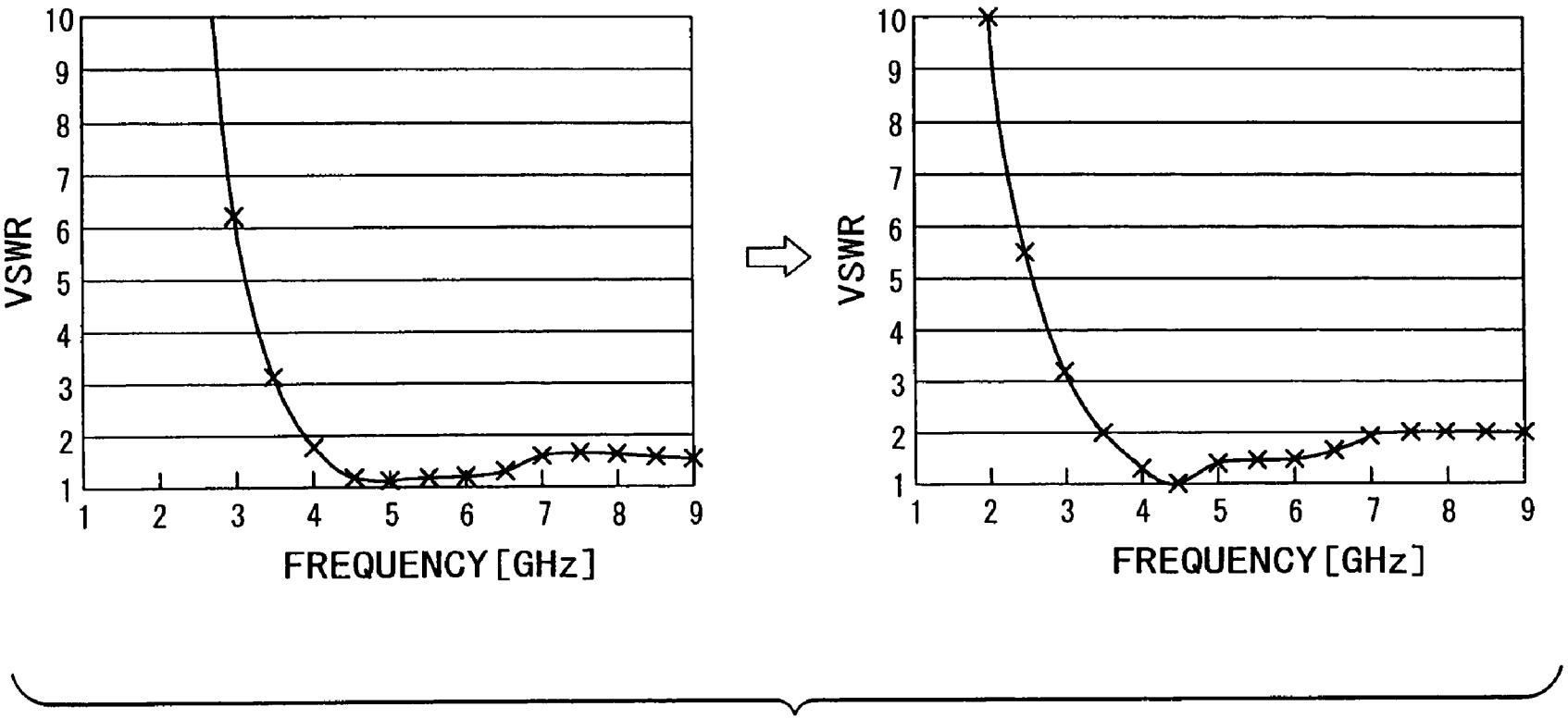
FIG. 21 is a drawing illustrating an example of computation for demonstrating the electrical effect of the monoconical antenna according to the third embodiment of the present invention.

FIG. 21 illustrates an example of computation for demonstrating the electrical effect of the monoconical antenna according to this embodiment. On the left of the figure is a VSWR characteristic diagram obtained when the electrode stripped portion is not formed, and on the right is that obtained when the stripped portion is formed. (The other conditions are completely identical.) The conditions for the computation will be briefly described below. As is evident from the figure, the formation of the electrode stripped portion brings the following advantages: the band wherein VSWR is not more than 2 is expanded to the low-frequency band; the matching property is improved; and band widening of the conical antenna is accomplished.

(1) Radiation electrode portion: it is assumed that a metal with a conductivity of $1\times10^7$ S/m is used.
Upper base diameter: 12.6 mm, height: 12.6 mm.
(2) Low-conductivity member: it is assumed that a material with a conductivity of 2 S/m is used.
(3) Insulator: it is assumed that a dielectric with a relative dielectric constant of 4 is used.

In the example of the constitution of conical antenna illustrated in FIG. 20, one circumferential stripped portion is formed in the radiation electrode formed on the internal surface of the concavity in the insulator. The subject matter of the present invention does not limit the number of the circumferential stripped portions to one. More specific description will be given. As mentioned above, the presence of the low-conductivity member between the radiation electrodes divided by the stripped portion produces the electrical effect equivalent to resistive loading. For this purpose, two or more circumferential stripped portions may be provided as required.

Figure 22:
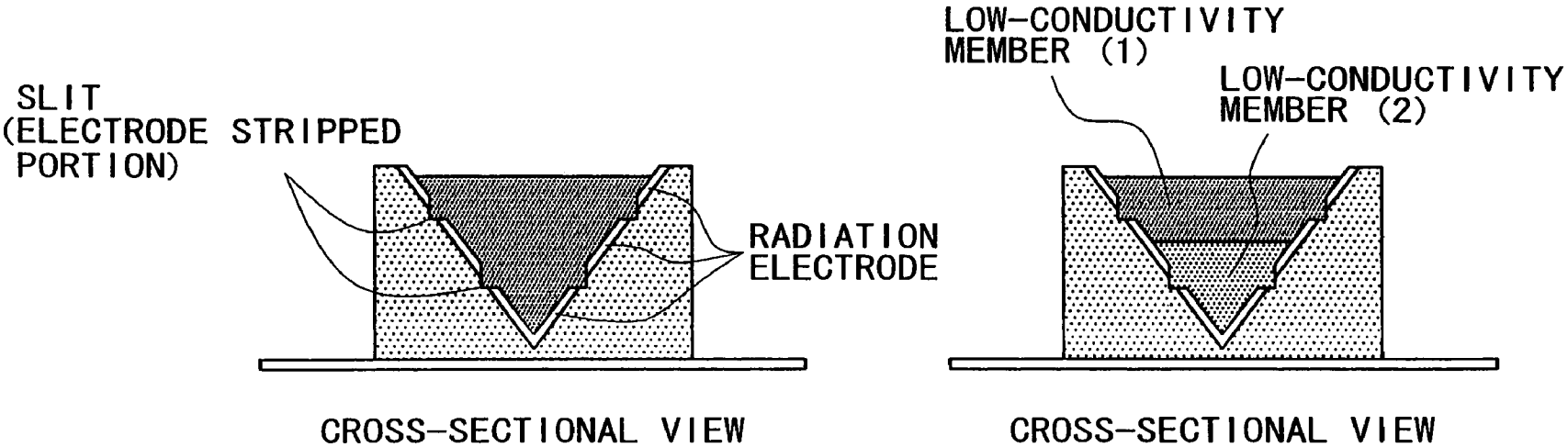
FIG. 22 is drawings illustrating the constitutions of antennas wherein two electrode stripped portions are formed in the direction of the depth of the concavity formed in an insulator.

FIG. 22 illustrates the constitutions of conical antennas wherein two electrode stripped portions are formed in the direction of the depth of the concavity formed in an insulator. In this case, the low-conductivity member in the concavity may be provided with multilayer structure as illustrated on the right side of the figure. The multilayer structure is such that low-conductivity members different in conductivity are filled level by level at which each electrode stripped portion is buried. At this time, the low-conductivity members are so distributed that the conductivity is lower on the upper base side. Thus, the effect of diminishing reflective power to the feeding portion is enhanced, and this results in expanded matching band.

Figure 23:
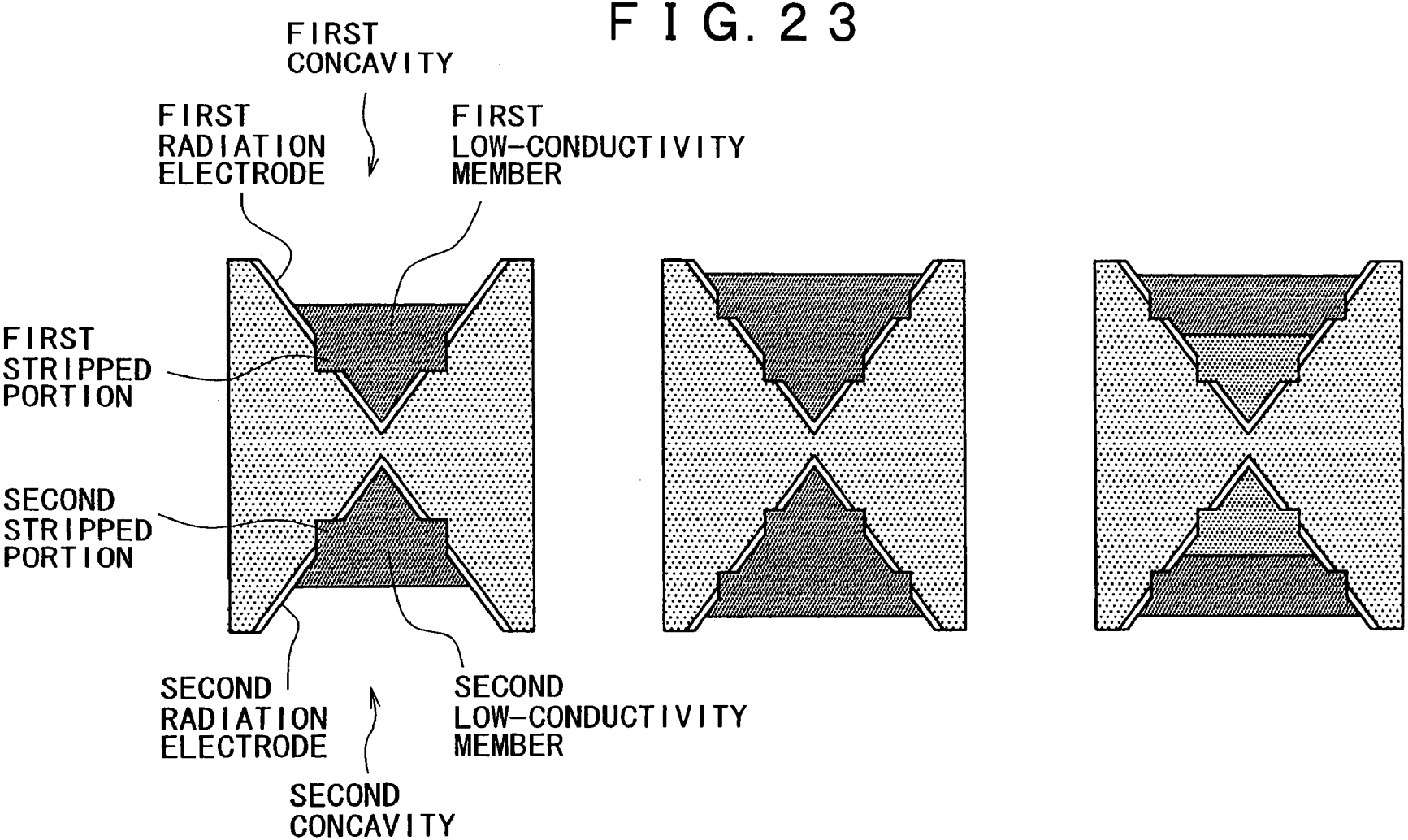
FIG. 23 is drawings illustrating examples wherein the formation of the ground conductor on the other end face of the insulator. In these examples, resistive loading according to the present invention is applied to biconical antennas constituted by disposing radiation electrodes on the internal surfaces of substantially conical concavities symmetrically formed in both the end faces.

The scope of the present invention is not limited to monoconical antenna, and the present invention is effective as a resistive loading method for biconical antenna. FIG. 23 illustrates examples wherein the formation of the ground conductor on the other end face of the insulator. In these examples, the resistive loading according to the present invention is applied to biconical antennas formed by disposing radiation electrodes on the internal surfaces of substantially conical concavities symmetrically formed in both the end faces.

Each of the biconical antennas illustrated in the figure comprises: an insulator; a first substantially conical concavity formed in one end face of the insulator; a first radiation electrode formed on the internal surface of the first concavity; a first stripped portion obtained by circumferentially stripping part of the first radiation electrode; a first low-conductivity member filled in the concavity to the level at which at least the first stripped portion is buried; a second substantially conical concavity formed in the other end face of the insulator; a second radiation electrode formed on the internal surface of the second concavity; a second stripped portion obtained by circumferentially stripping part of the second radiation electrode; and a second low-conductivity member filled in the concavity to the level at which at least the second stripped portion is buried.

In the examples illustrated in FIG. 23, electrical signals are fed to the gap between both the radiation electrodes. For this purpose, various methods can be used. For example, parallel lines can be extended from the insulator side face and connected to the vertex regions of both the radiation electrodes. (This method is not shown in the figure.)

As described in connection with FIG. 22, the presence of the low-conductivity member between the radiation electrodes divided by the stripped portion produces the electrical effect equivalent to resistive loading. If the resistive loading according to the present invention is applied to a biconical antenna, this constitution can be similarly adopted. That is, for the above-mentioned purpose, two or more circumferential stripped portions may be provided in each of the upper and lower radiation electrodes as required. (Refer to the center of FIG. 23.)

As illustrated on the right side of FIG. 23, the low-conductivity members in the concavities may be provided with multilayer structure. The multilayer structure is such that the low-conductivity members different in conductivity are respectively filled to the level at which each electrode stripped portion is buried. At this time, the low-conductivity members are so distributed that the conductivity is lower on the base side. Thus, the effect of diminishing reflective power to the feeding portion is enhanced, and this results in expanded matching band.

Figure 24:
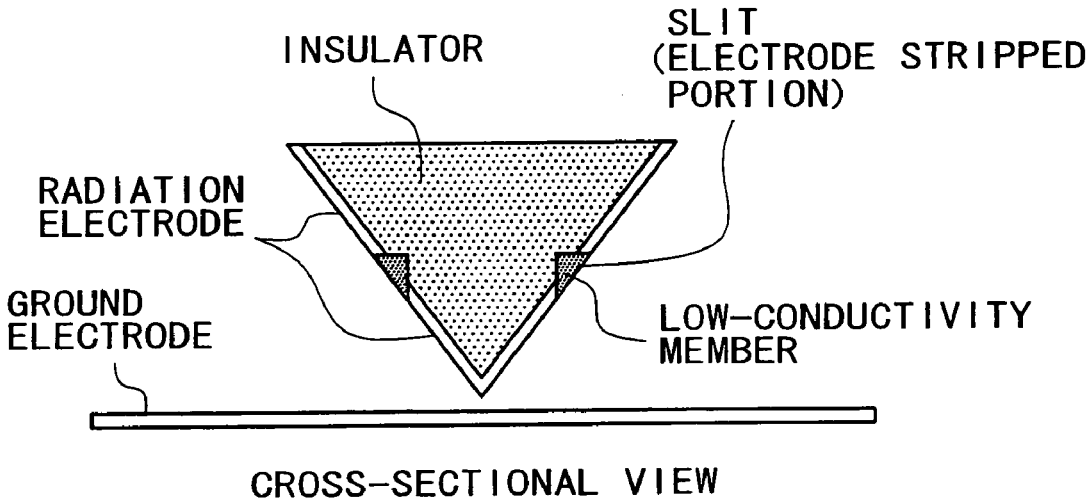
FIG. 24 is a drawing illustrating the cross-sectional structure of an antenna according to another embodiment of the present invention.

FIG. 24 illustrates the cross-sectional structure of a monoconical antenna which is a modification to the third embodiment of the present invention. The monoconical antenna illustrated in the figure comprises: an insulator formed in substantially conical shape; a radiation electrode formed on the surface of the substantially conical insulator; a circumferential slit portion which circumferentially divides part of the radiation electrode together with the insulator thereunder; a low-conductivity member filled in the circumferential slit portion; and a ground conductor provided in proximity to the near vertex region of the radiation electrode.

In the example illustrated in FIG. 24, the radiation electrode is first formed on the surface of the insulator formed in conical shape. The radiation electrode can be formed by plating or the like. Subsequently, part of the radiation electrode is circumferentially stripped and cut together with the insulator thereunder by cutting or the like. The thus obtained stripped and cut portion is filled with the low-conductivity member. For the low-conductivity member, rubber or elastomer containing conductor is suitable. A desired conductivity is obtained with comparative ease by adjusting the conductor content. Further, the ground conductor is provided in proximity to the vertex region of the radiation electrode.

With the constitution of monoconical antenna illustrated in FIG. 24, the presence of the low-conductivity member between the two divided radiation electrodes produces the electrical effect equivalent to resistive loading. (This is the same as the foregoing.)

Needless to add, a support for fixing the disposition of the ground conductor and the insulator is separately required though it is not shown in FIG. 24.

In the example of the constitution of a conical antenna illustrated in FIG. 24, the radiation electrode formed on the surface of the insulator is provided with only one circumferential stripped and cut portion. The subject matter of the present invention does not limit the number of the circumferential stripped and cut portions to one. More specific description will be given. As mentioned above, the presence of the low-conductivity member between the radiation electrodes divided by the stripped portion produces the electrical effect equivalent to resistive loading. For this purpose, two or more circumferential stripped and cut portions may be provide as required.

Figure 25:
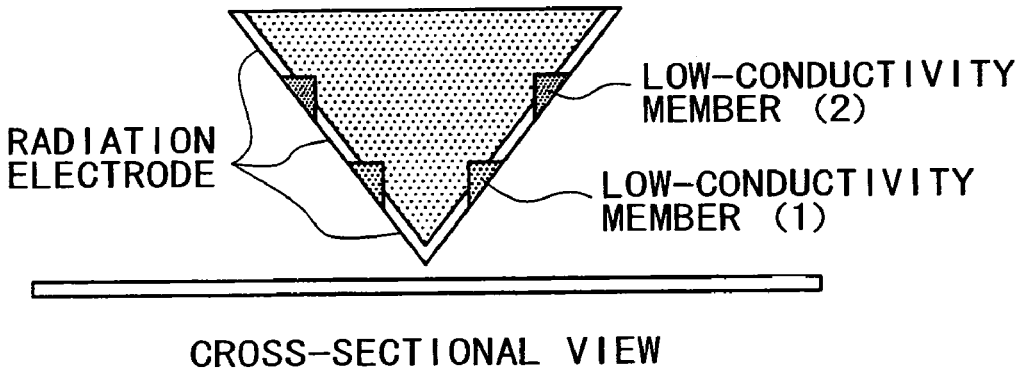
FIG. 25 is a drawing illustrating the constitution of a conical antenna wherein two stripped and cut portions are formed in the direction of the depth of the substantially conical radiation electrode formed on an insulator.

FIG. 25 illustrates the constitution of a conical antenna wherein two stripped and cut portions are formed in the direction of the depth of the substantially conical radiation electrode formed on an insulator. In this case, low-conductivity members different in conductivity may be filled in the individual stripped and cut portions. At this time, the low-conductivity members are so distributed that the conductivity is lower on the base side of the insulator. Thus, the effect of diminishing reflective power to the feeding portion is enhanced, and this results in expanded matching band.

Figure 26:
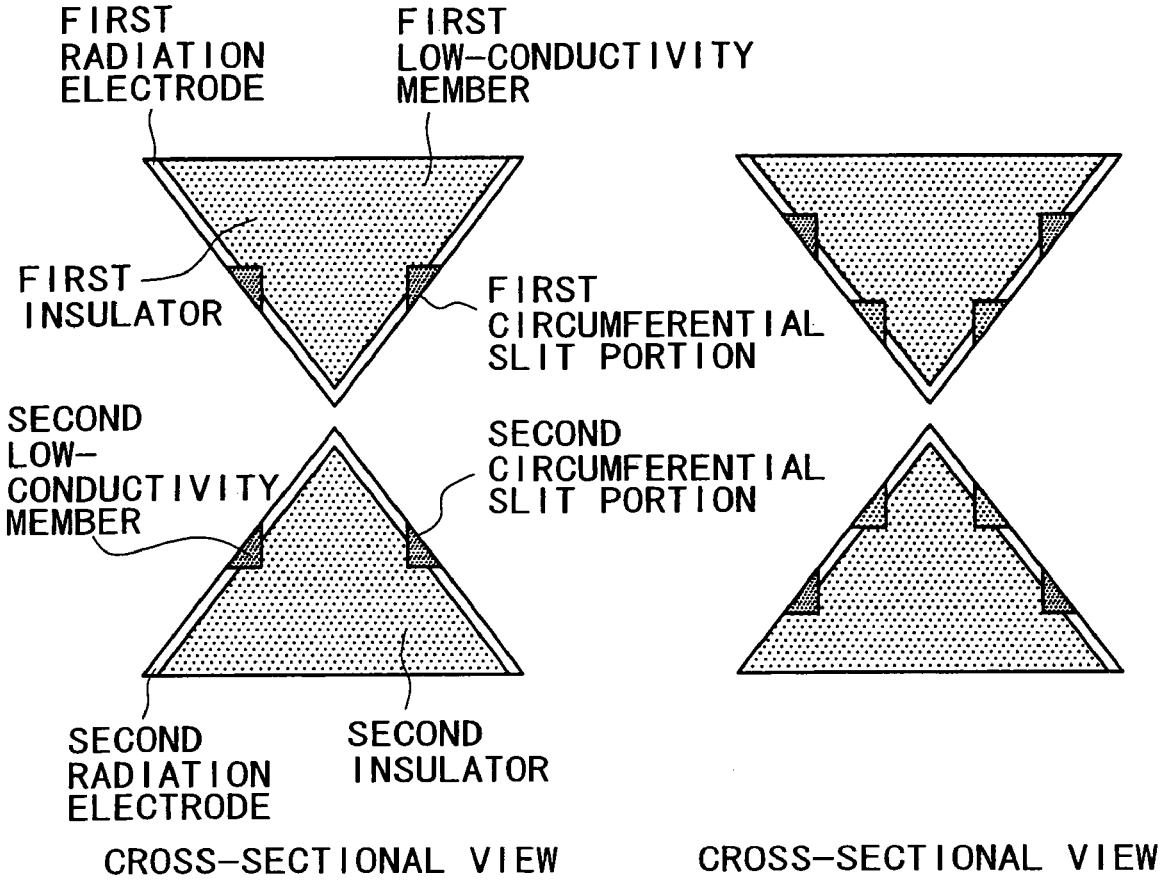
FIG. 26 is a drawing illustrating examples of the constitutions of biconical antennas constituted using conical antennas which are formed by providing circumferential stripped and cut portions in the radiation electrodes formed on the surfaces of conical insulators.

The scope of the embodiment of the present invention illustrated in FIG. 24 is not limited to monoconical antenna, and the embodiment is effective as a resistive loading method for biconical antenna. FIG. 26 illustrates examples of the constitutions of biconical antennas using conical antennas which are formed by providing circumferential stripped and cut portions in the radiation electrodes formed on the surfaces of conical insulators.

Biconical antenna illustrated or the left of FIG. 26 comprises a first insulator formed in substantially conical shape; a first radiation electrode formed on the surface of the substantially conical insulator; a first circumferential slit portion which circumferentially divides part of the first radiation electrode together with the insulator thereunder; a first low-conductivity member filled in the first circumferential slit portion; a second insulator formed in substantially conical shape whose vertex is opposed to that of the first insulator and whose base is symmetrical with that of the first insulator; a second radiation electrode formed on the surface of the substantially conical insulator; a second circumferential slit portion which circumferentially divides part of the second radiation electrode together with the insulator thereunder; and a second low-conductivity member filled in the second circumferential slit portion.

As illustrated in FIG. 26, the formation of the ground conductor on the other end face of each insulator in proximity to the near vertex region of the radiation electrode is omitted. The conical insulators are so disposed that their respective vertexes are opposed to each other and their respective bases are symmetrical with each other, and the radiation electrode is formed on the surface of each conical insulator. Part of each radiation electrode is circumferentially stripped and cut together with the insulator thereunder, and these stripped and cut portions are filled with the low-conductivity member. Needless to add, a support for fixing the disposition of the two conical antennas is required though it is not shown in the figure.

In the example illustrated in FIG. 26, electrical signals are fed to the gap between both the radiation electrodes. For this purpose, various methods can be used. For example, parallel lines can be extended from the insulator side face and connected to the vertex regions of both the radiation electrodes. (This method is not shown in the figure.)

As mentioned above, the present of the low-conductivity member between the radiation electrodes divided by the stripped and cut portion produces the electrical effect equivalent to resistive loading. If the resistive loading according to the embodiment of the present invention illustrated in FIG. 24 is applied to a biconical antenna, this constitution can be similarly adopted. For this purpose, as described in connection with FIG. 25, two or more circumferential stripped and cut portions may be provided in each of the upper and lower radiation electrode as required. (Refer to the right side of FIG. 26.)

As illustrated on the right side of FIG. 26, low-conductivity members different in conductivity may be filled in the two stripped and cut portions formed in the direction of the depth of the substantially conical radiation electrode formed on each of the upper and lower insulators. At this time, the low-conductivity members are so distributed that the conductivity is lower on the upper base side. Thus, the effect of diminishing reflective power to the feeding portion is enhanced, and this results in expanded matching band.

Figure 27:
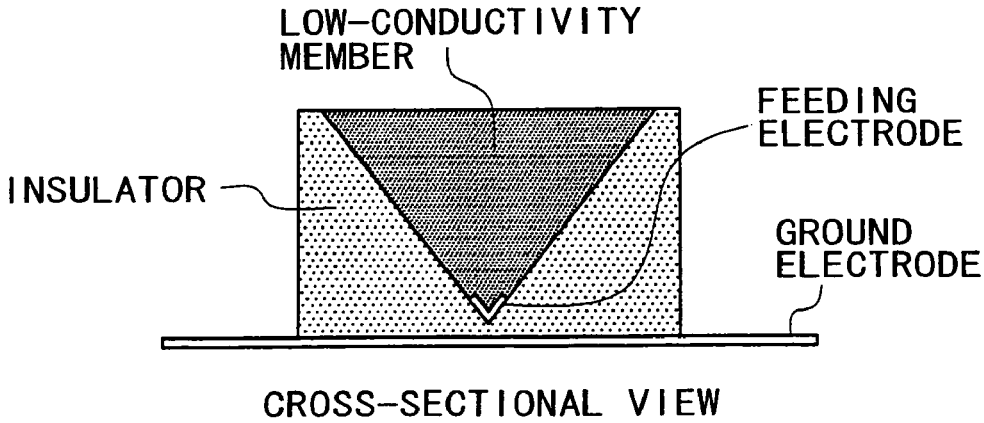
FIG. 27 is a drawing illustrating the cross-sectional structure of the conical antenna according to a further embodiment of the present invention.

FIG. 27 illustrates the cross-sectional structure of a monoconical antenna which is another modification to the third embodiment of the present invention. The monoconical antenna illustrated in the figure comprises: an insulator; a substantially conical concavity provided in one end face of the insulator; a feeding electrode formed on the surface of the near vertex region in the concavity; a low-conductivity member filled in the concavity; and a ground conductor provided in proximity to and substantially in parallel with the other end face of the insulator or formed directly on the other end face of the insulator.

In the example illustrated in the figure, the conical concavity is first formed in the surface of the insulator, and then the feeding electrode is formed on the internal surface of the concavity in proximity to its vertex. The feeding electrode can be formed by plating or the like. Subsequently, the concavity is filled with the low-conductivity member. For the low-conductivity member, rubber or elastomer containing conductor is suitable. A desired conductivity is obtained with comparative ease by adjusting the conductor content. Then, the ground conductor is provided in proximity to and substantially in parallel with the other end face of the insulator. Alternatively, the ground conductor may be formed directly on the other end face of the insulator.

With the constitution of monoconical antenna illustrated in FIG. 27, the low-conductivity member functions as a radiation conductor, and further the electrical effect equivalent to resistive loading is obtained. As illustrated in the figure, the area of the electrode is significantly reduced, and the cost can be accordingly reduced. Unlike the above-mentioned embodiments, the electrode stripping process is omitted, and the cost can be accordingly reduced.

Electrical signals are fed to the gap between the feeding electrode and the ground conductor. If electric signals are fed from the back face side of the ground conductor, such a constitution that a hole is made in the ground conductor and the vertex region of the concavity is extended to the back face side may be adopted.

Figure 28:
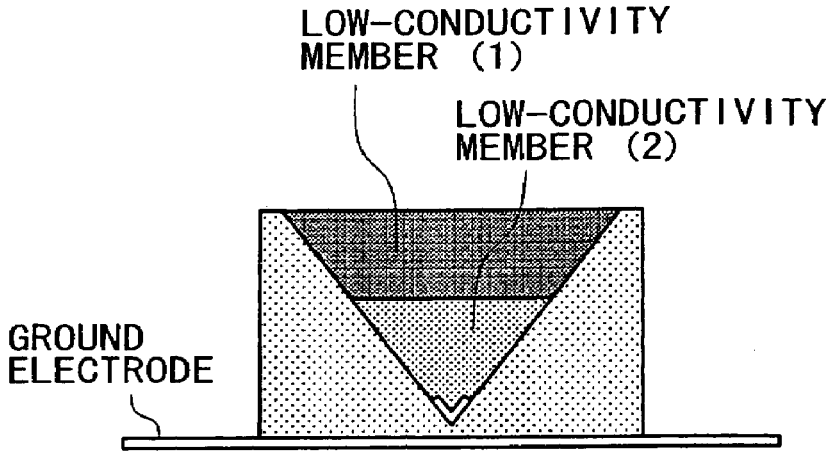
FIG. 28 is a drawing illustrating the cross-sectional structure of a modification to the conical antenna illustrated in FIG. 27.

FIG. 28 illustrates a modification to the monoconical antenna illustrated in FIG. 27. As illustrated in FIG. 28, the low-conductivity member filled in the concavity may be provided with multilayer structure wherein members different in conductivity are respectively filled to individual predetermined levels. At this time, the low-conductivity members are so distributed that the conductivity is lower on the upper base side. Thus, the effect of diminishing reflective power to the feeding portion is enhanced, and this results in expanded matching band.

Figure 29:
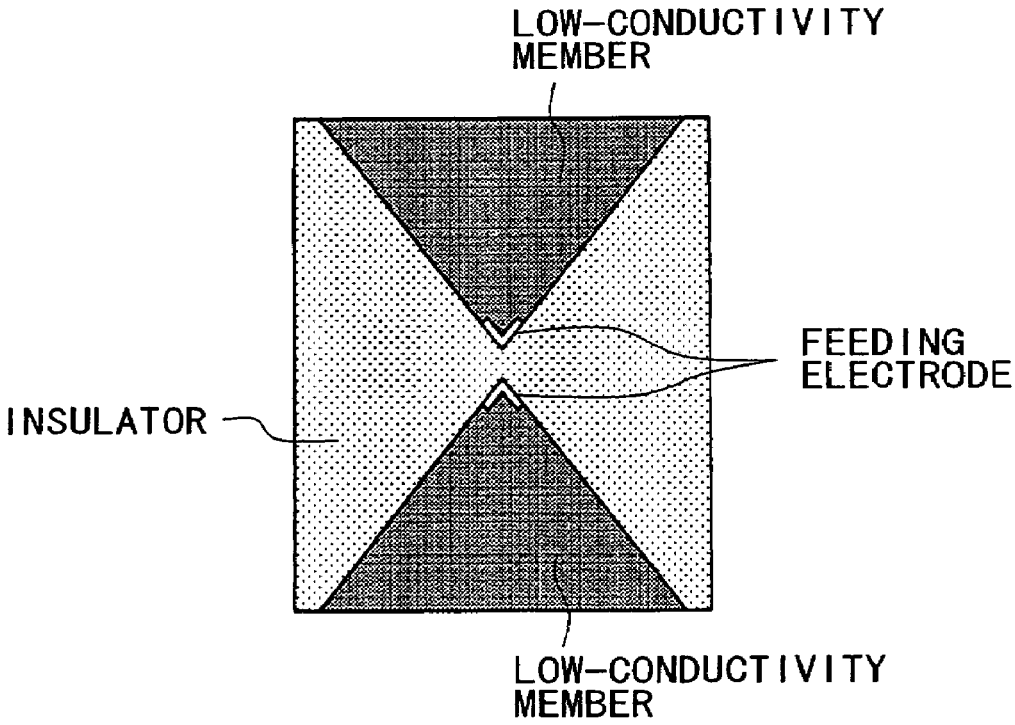
FIG. 29 is a drawing illustrating the constitution of a biconical antenna constituted using a conical antenna which is formed by filling a low-conductivity member in the feeding electrode formed on the surfaces of the conical concavities in an insulator.

The scope of the embodiment of the present invention illustrated in FIG. 27 is not limited to monoconical antenna, and the embodiment is effective as a resistive loading method for biconical antenna. FIG. 29 illustrates the cross-sectional structure of a biconical antenna constituted using conical antennas which are formed by filling a low-conductivity member in feeding electrodes formed on the surfaces of the conical concavities in an insulator.

In the biconical antenna illustrated in FIG. 29, the formation of the ground conductor on both the end faces of the insulator is omitted. The biconical antenna comprises: a first conical concavity and a second conical concavity symmetrically formed in both the end faces; a first feeding electrode formed on the surface of the near vertex region in the first concavity; a first low-conductivity member filled in the first concavity; a second feeding electrode formed on the surface of the near vertex region in the second concavity; and a second low-conductivity member filled in the second concavity.

With the constitution of biconical antenna illustrated in FIG. 29, the low-conductivity members function as radiation conductors, and further the electrical effect equivalent to resistive loading is obtained. As illustrated in the figure, the area of the electrodes is significantly reduced, and the cost can be accordingly reduced. Unlike the above-mentioned embodiments, the electrode stripping process is omitted, and the cost can be accordingly reduced.

In the example illustrated in FIG. 29, electrical signals are fed to the gap between the first and second feeding electrodes. For this purpose, various methods can be used. For example, parallel lines can be extended from the insulator side face and connected to the vertex regions of both the radiation electrodes. (This method is not shown in the figure.)

Figure 30:
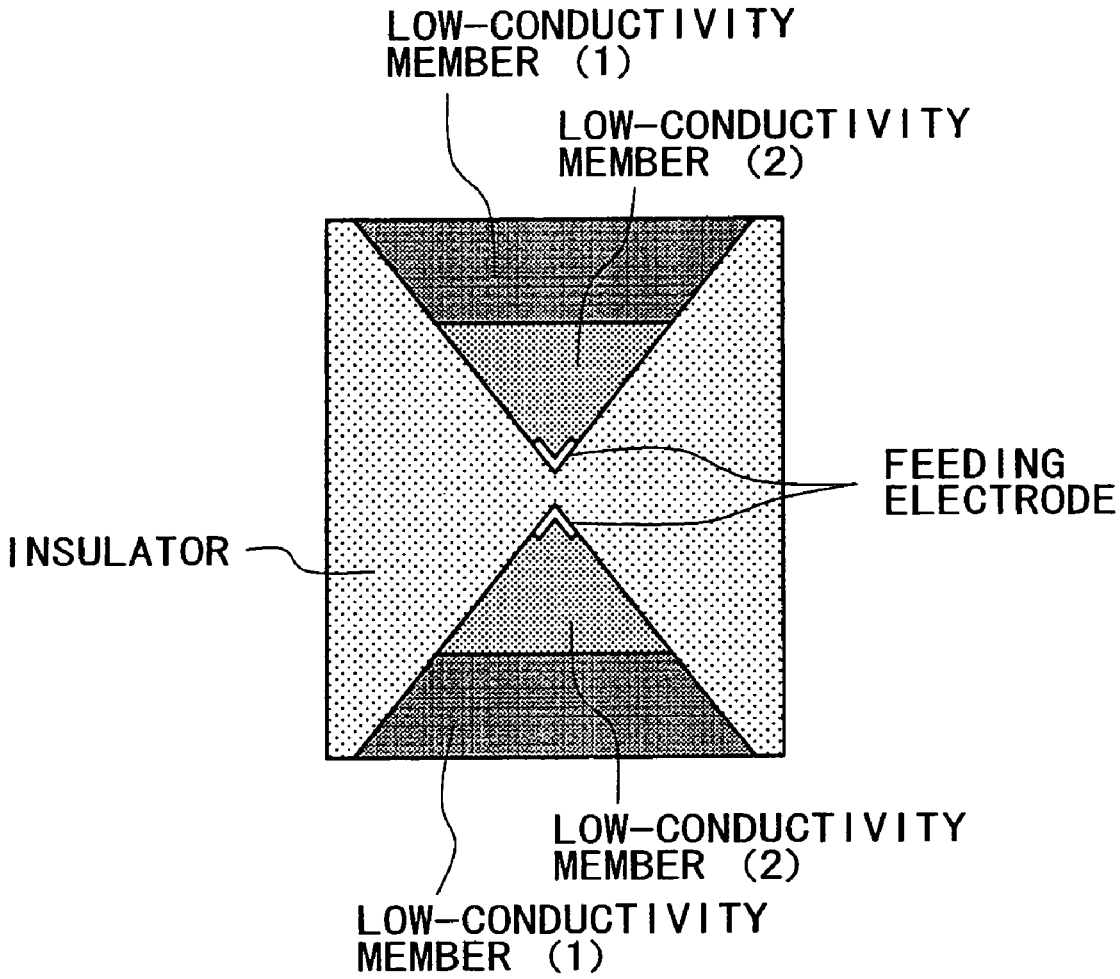
FIG. 30 is a drawing illustrating the cross-sectional structure of a modification to the conical antenna illustrated in FIG. 29.
Figure 31:
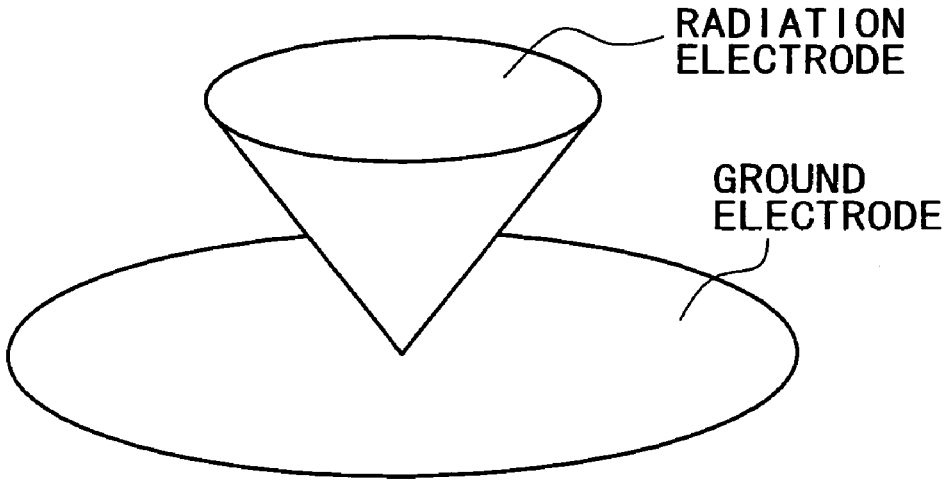
FIG. 31 is a drawing illustrating the constitution (conventional example) of a monoconical antenna having a single conical radiation electrode.
Figure 32:
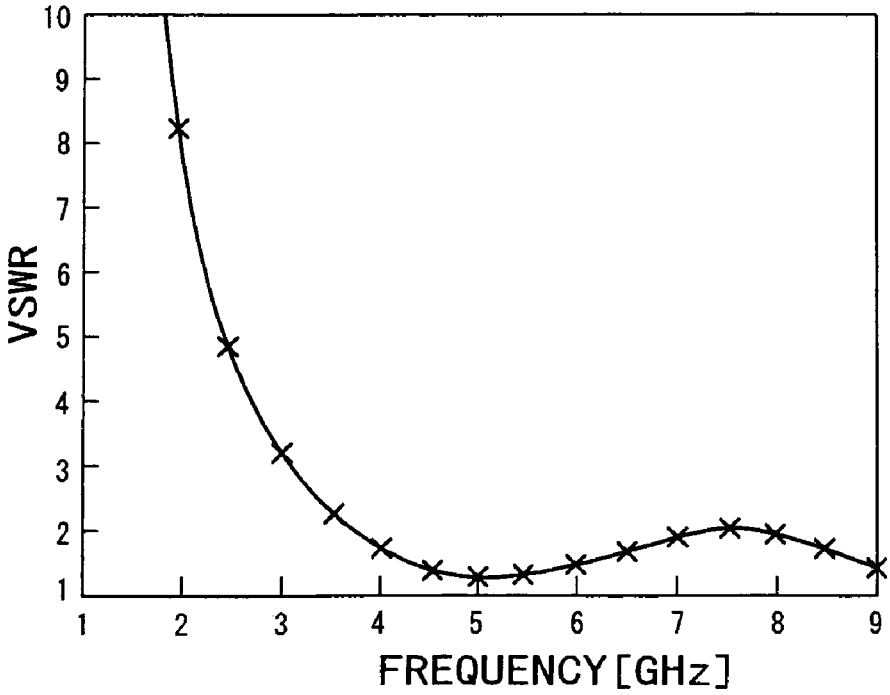
FIG. 32 is a drawing illustrating an example (conventional example) of the VSWR (Voltage Standing Wave Ratio) characteristics of a monoconical antenna.
Figure 33:
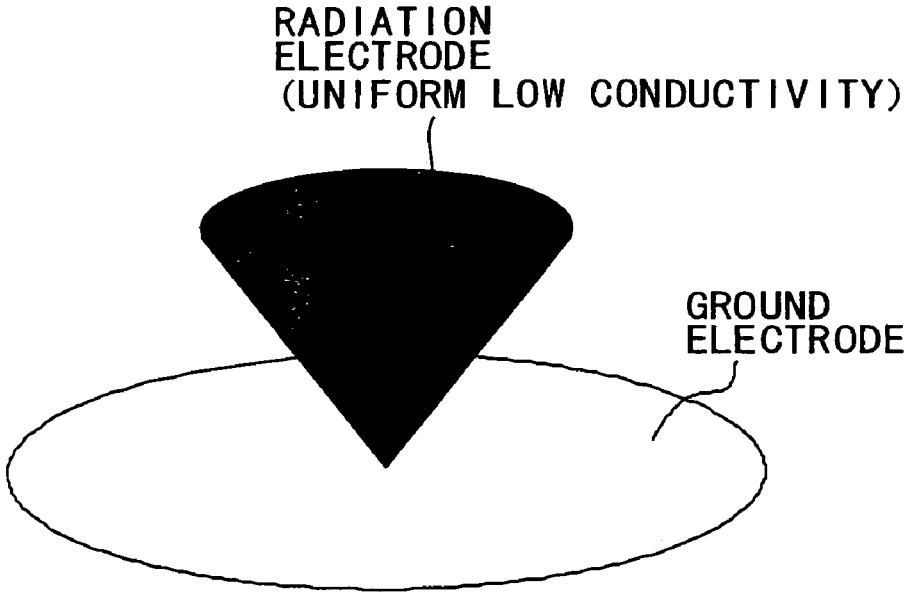
FIG. 33 is a drawing illustrating the constitution (conventional example) of a monoconical antenna wherein a radiation conductor is constituted of a low-conductivity member containing a resistance component in place of high-conductivity metal.
Figure 34:
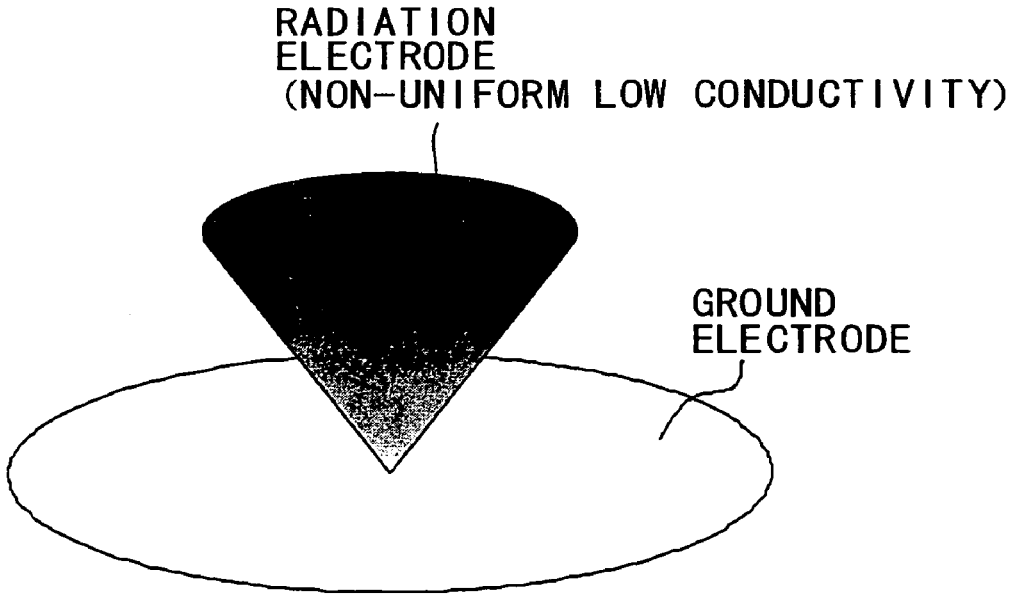
FIG. 34 is a drawing illustrating the constitution (conventional example) of a monoconical antenna wherein a radiation conductor is constituted of a non-uniform low-conductivity member containing a resistance component in place of high-conductivity metal.

FIG. 30 illustrates an modification to the biconical antenna illustrated in FIG. 29. As illustrated in FIG. 30, the low-conductivity member filled in each concavity may be provided with multilayer structure wherein members different in conductivity are respectively filled to individual predetermined levels. At this time, the low-conductivity members are so distributed that the conductivity is lower on the upper base side. Thus, the effect of diminishing reflective power to the feeding portion is enhanced, and this results in expanded matching band.

In the embodiments mentioned above referring to the figures, the radiation electrode of the conical antenna is formed in conical shape. The subject matter of the present invention is not limited to this, and even if the shape of the radiation electrode is elliptic cone or pyramid, the effect of the present invention is equally produced. There is no special limitation on the outside shape of the insulator cylinder, either and basically, any shape, including circular cylinder and prism, easy to handle may be adopted. Further, the insulator is not limited to dielectric, and even a magnetic material does not have influence on the essential effect of the present invention.

Up to this point, the present invention has been described in detail referring to specific embodiments. However, it is further understood by those skilled in the art that various changes and modifications may be made in the embodiments without departing from the spirit and scope of the present invention. That is, the present invention has been disclosed in the form of exemplification, and all matter contained therein shall not be interpreted in a limiting sense. The scope of the present invention is therefore to be determined solely by the appended claims.

INDUSTRIAL APPLICABILITY

According to the present invention, an excellent monoconical antenna wherein its inherent quality of wideband characteristics is sufficiently maintained and further size reduction is accomplished by dielectric loading can be provided.

Further, according to the present invention, the scope of application of a dielectric loading monoconical antenna can be dramatically expanded and thus the antenna can be brought into practical use, for example, as a small antenna for ultra-wide band communication system.

Further, according to the present invention, an excellent monoconical antenna wherein reduction in profile and width is accomplished regardless of the selection of dielectric can be provided.

Further, according to the present invention, an excellent monoconical antenna having a feeding portion structure suitable for mass production can be provided.

If the constituting methods according to the present invention are used when a monoconical antenna is reduced in size by dielectric loading, the quality of wideband characteristics inherent in the monoconical antenna can be sufficiently maintained. At the same time, the low-profile or slender constitution can be adopted. The thus obtained antenna is useful, for example, as a small, low-profile antenna or small, slender antenna for ultra-wide band communication system.

Further, according to the present invention, an excellent conical antenna wherein resistance is loaded on its radiation conductor for band widening can be obtained.

Further, according to the present invention, an excellent conical antenna comprising a radiation conductor which can be mass-produced with ease and is constituted by resistive loading can be provided.

If the constituting methods according to the present invention are used when a monoconical antenna or biconical antenna is widened in band or reduced in size by resistive loading, the antenna can be mass-produced with ease. Then, the scope of application of the resistive loading conical antenna can be expanded to consumer products. For example, the antenna can be brought into practical use as a small antenna for consumer ultra-wide band communication system.

The invention claimed is:

1. A conical antenna comprising:

an insulator;

a substantially conical concavity provided in one end face of said insulator;

a radiation electrode formed on the internal surface of said concavity;

an annular recess obtained by circumferentially stripping part of said radiation electrode and a part of said insulator, the annular recess including two mutually perpendicular surfaces;

a low-conductivity member filled in said concavity to the level at which said annual recess is formed; and a ground conductor provided in proximity to and substantially in parallel with the other end face of said insulator or formed directly on the other end face of said insulator.

2. The conical antenna according to claim 1, wherein said radiation electrode is formed on the internal surface of said concavity by plating or the like.

3. The conical antenna according to claim 1, wherein said low-conductivity member is formed of rubber or elastomer containing conductor.

4. The conical antenna according to claim 1, wherein electrical signals are fed to a gap between said radiation electrode and said ground conductor.

5. The conical antenna according to claim 1, wherein a hole is made in the ground conductor and the vertex region of the radiation electrode is extended to the back face side for feeding electrical signals.

6. The conical antenna according to claim 1, wherein two or more annular recessed portions obtained by circumferentially stripping part of said radiation electrode and a part of said insulator are provided.

7. The conical antenna according to claim 6, wherein said low-conductivity member filled in said concavity is of a multilayer structure wherein members different in conductivity are filled in said concavity level by level at which each of said annular recessed portions are formed.

8. The conical antenna according to claim 6, wherein the low-conductivity members are so distributed that the conductivity is lower on the base side of said concavity.

9. A manufacturing method for conical antenna comprising the steps of:

forming a substantially conical concavity in one end face of an insulator;

forming a radiation electrode on the internal surface of said concavity;

stripping part of said radiation electrode and a part of said insulator to form an annular recess, which includes two mutually perpendicular surfaces; and filling a low-conductivity member in said concavity to the level at which said stripped portion is buried.

10. The manufacturing method for conical antenna according to claim 9, further comprising the step of:

providing a ground conductor in proximity to and in parallel with the other end face of said insulator or directly on the other end face of said insulator.

* * * * *